US009151582B2

(12) United States Patent
Scott

(10) Patent No.: US 9,151,582 B2
(45) Date of Patent: Oct. 6, 2015

(54) REMOTE TREATMENT SYSTEM

(71) Applicant: Alastair Gordon Scott, Riederau am Ammersee (DE)

(72) Inventor: Alastair Gordon Scott, Riederau am Ammersee (DE)

(73) Assignee: Coolgardie, LLC, Conroe, TX (US)

( * ) Notice: Subject to any disclaimer, the term of this patent is extended or adjusted under 35 U.S.C. 154(b) by 0 days.

(21) Appl. No.: 13/804,838

(22) Filed: Mar. 14, 2013

(65) Prior Publication Data

US 2014/0261045 A1 Sep. 18, 2014

(51) Int. Cl.
*F42B 12/36* (2006.01)
*F42B 12/54* (2006.01)

(52) U.S. Cl.
CPC ..... *F42B 12/36* (2013.01); *F42B 12/54* (2013.01)

(58) Field of Classification Search
CPC ..... F42B 12/36; F42B 12/46; F42B 12/54
USPC ..... 102/502, 512
See application file for complete search history.

(56) References Cited

U.S. PATENT DOCUMENTS

| | | | | |
|---|---|---|---|---|
| 3,502,025 | A * | 3/1970 | Payne | 102/512 |
| 3,584,582 | A * | 6/1971 | Muller | 102/512 |
| 3,820,465 | A * | 6/1974 | Delphia | 102/512 |
| 4,243,036 | A * | 1/1981 | Ott | 604/130 |
| 5,318,576 | A | 6/1994 | Plassche, Jr. et al. | |
| 6,736,070 | B2 * | 5/2004 | Baltos | 102/512 |
| 6,807,908 | B2 * | 10/2004 | Brydges-Price | 102/512 |
| 7,013,810 | B1 * | 3/2006 | Brydges-Price | 102/502 |
| 7,993,348 | B2 | 8/2011 | Conte et al. | |
| 2005/0107738 | A1 | 5/2005 | Slater et al. | |

FOREIGN PATENT DOCUMENTS

| | | | |
|---|---|---|---|
| DE | 2260529 | A1 * | 6/1974 |
| GB | 2393236 | A * | 3/2004 |

OTHER PUBLICATIONS

International Search Report and Written Opinion for Application No. PCT/US2014/027445, dated Jul. 25, 2014.

* cited by examiner

*Primary Examiner* — James S Bergin
(74) *Attorney, Agent, or Firm* — Marshall, Gerstein & Borun LLP

(57) ABSTRACT

A remote treatment system may include a syringe assembly and a cone assembly. The syringe assembly may further include a cannula that has a solid bevel tip and an exit port on a longitudinal side of the cannula. The cone assembly may include a fore-end ring at the cone assembly apex and a base ring at a center of the cone assembly base. The fore-end ring and base ring may carry the cannula and the fore-end ring may be shiftable along the longitudinal axis of the cannula between an extended first position and a retracted second position. The fore-end ring may be in a sealing relation with the cannula exit port in the extended first position, while the exit port may be unsealed in the retracted second position. In response to an impact between the cone assembly and a target, the fore-end ring may shift to its second position.

55 Claims, 20 Drawing Sheets

200

200

REMOTE TREATMENT SYSTEM

TECHNICAL FIELD

The invention relates generally to devices for delivering a payload by a projectile fired from a remote location to a target.

BACKGROUND

The background description provided herein is for the purpose of generally presenting the context of the disclosure. Work of the presently-named inventors, to the extent it is described in this background section, as well as aspects of the description that may not otherwise qualify as prior art at the time of filing, are neither expressly nor impliedly admitted as prior art against the present disclosure.

Remote inoculation or treatment systems (RTS) are mechanical devices capable of administering a liquid or other payload (e.g., a vaccine, an anesthetic, other medical treatment, a tracking device, etc.) in a single dose to a target, such as the soft tissue of an unrestrained animal, usually by means of a ballistic projectile. A typical RTS includes a gun and a dart containing a product. However, modern delivery systems suffer many shortcomings. For example, the target must be first located and then approached closely. Under most circumstances, animals, or other targets must be within thirty yards of the shooter for a projectile-RTS to be effective. Many animal species are secretive and extremely difficult to locate, let alone approach closely. Also, many RTS can be used only on larger animals. Typical RTS using projectiles tend to be inaccurate and the preferred target area on smaller animals may be very small. A misplaced shot might easily injure or kill the target. Even if placed correctly, the impact energy or penetration depth could be injurious or lethal to smaller animals. Furthermore, training and experience are necessary and most RTS should not be used without some degree of formal instruction by experienced practitioners.

SUMMARY

In accordance with an embodiment of the remote treatment system, a cone assembly may include a fore-end ring at a cone assembly apex and a base ring at a center of a cone assembly base. The fore-end ring and base ring may radially join a plurality of deformable sections around a cylindrical core extending through the fore-end ring and the base ring. Each section may include a first portion, a second portion, and a pivot connecting the first portion to the second portion, and each section may be shiftable about the pivot between an undeformed first position and a deformed second position. A payload assembly may include a cannula carried by the cylindrical core. The fore-end ring may be in a sealing relation to the cannula, with the fore-end ring being shiftable along a longitudinal axis of the cannula between an extended first position and a retracted second position. In response to an impact between the cone assembly and a target, each section of the cone assembly and the fore-end ring may shift to its respective second position.

In accordance with another embodiment of the remote treatment system, a syringe assembly may include a cannula. The cannula may include a solid bevel tip and an exit port on a longitudinal side of the cannula. A cone assembly may include a fore-end ring at a cone assembly apex and a base ring at a center of a cone assembly base. The fore-end ring and base ring may carry the cannula. The fore-end ring may be shiftable along a longitudinal axis of the cannula between an extended first position and a retracted second position. The fore-end ring may be in a sealing relation with the cannula exit port in the extended first position, while the exit port may be unsealed with the fore-end ring in the retracted second position. The fore-end ring and base ring may be joined by one or more deformable sections. In response to an impact between the cone assembly and a target, the fore-end ring may shift to its second position.

In accordance with still another embodiment of the remote treatment system, a syringe assembly may include a cannula. The cannula may include a solid bevel tip and an exit port on a longitudinal side of the cannula. A cone assembly may include a fore-end ring at the cone assembly apex and a base ring at a center of the cone assembly base. The fore-end ring and base ring may carry the cannula, and the fore-end ring may be shiftable along a longitudinal axis of the cannula between an extended first position and a retracted second position. The fore-end ring may be in a sealing relation with the cannula exit port in the extended first position, and the exit port may be unsealed with the fore-end ring in the retracted second position. The fore-end ring and base ring may be joined by one or more deformable sections. Each deformable section may include an inner rib, an outer rib, and a pivot connecting the inner rib to the outer rib. Further, each section may be shiftable about the pivot between an undeformed first position and a deformed second position. In response to an impact between the cone assembly and a target, each deformable section of the cone assembly and the fore-end ring may shift to its respective second position.

The features and advantages described in this summary and the following detailed description are not all-inclusive. Many additional features and advantages may be apparent to one of ordinary skill in the art in view of the drawings, specification, and claims hereof.

BRIEF DESCRIPTION OF THE DRAWINGS

Embodiments of the disclosure are better understood with reference to the following drawings.

Figure 1:
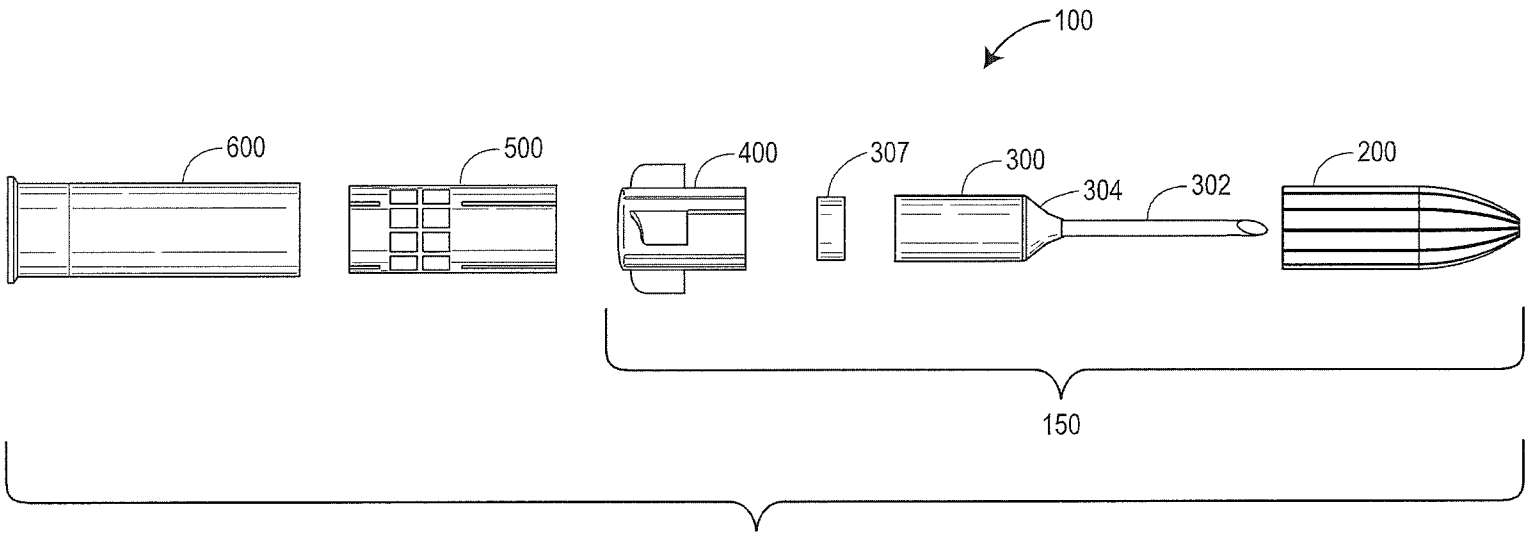
FIG. 1 is an exploded view of components of a remote treatment system.

Throughout the drawings, like reference numerals refer to like, similar or corresponding features or functions. The drawing figures depict a preferred embodiment of the invention for purposes of illustration and clearness of understanding only. One skilled in the art will readily recognize from the following discussion that alternative embodiments of the structures and methods illustrated herein may be employed without departing from the principles of the invention described herein.

DETAILED DESCRIPTION

In the following detailed description of the preferred embodiments, reference is made to the accompanying drawings, which illustrate one or more specific embodiments for practicing the teachings of the invention. The illustrated embodiments are not intended to be exhaustive of all possible embodiments. Instead, those of skill in the art will understand that other possible embodiments may be utilized, and that structural or logical changes may be made without departing from the scope of the disclosure.

FIG. 1 illustrates an exploded view of several components or assemblies of a Remote treatment system (RTS), generally designated 100. As used herein, treatment or inoculation may be defined as any introduction of foreign matter into a target. A target may be any animal such as livestock, wild animals, humans, marine wildlife, avian wildlife, or any target into or onto which a payload may be delivered via syringe or other means as herein described. Treatment or inoculation may include introduction of a growth medium, anesthesia of an animal for handling or relocation, anti-parasitic management, biological and chemical control, broad spectrum and highly specific treatments in animal husbandry or wild animal management, control of indigenous life in security sector reform programs, disease prevention, drenching and worming, distribution of serums or antigenic substances, injecting of vitamins and minerals, delivery of any medicine and drug, introduction of a microorganism or other agent for disease eradication, microbial bacteriological genetic transfer, producing or boosting immunity to specific diseases, scientific and defense industry experimental research, and vaccination.

In some embodiments, the RTS 100 may be a fin-stabilized discarding sabot (FSDS) that is fired from a delivery device or system such as a smooth-bore firearm (i.e., a shotgun), a rifled shotgun or "slug-gun", a rifle, air gun, etc. The RTS may include a projectile assembly 150, a wad 600 (when deployed in a smooth-bore firearm), and a shell 700. The projectile assembly 150 may include a cone assembly 200, a syringe assembly 300, and a fins-cup assembly 400. Generally, the syringe assembly 300 is filled with a payload such as a vaccine, an anesthetic, vitamins, etc. The shotgun fires a charge in the shell which causes the wad 500 to carry the projectile assembly 150 through a barrel of the firearm. Once the wad 500 and the projectile assembly 150 reach the muzzle of the barrel, air resistance causes the wad 500 to fall away from the projectile assembly 150. The projectile assembly 150 then flies to a target, stabilized by fins on the fins-cup. The projectile assembly 150 then impacts the target, causing the cone assembly to flatten, a needle or cannula of the syringe assembly 300 to enter the target, and a payload of the syringe assembly 300 to be expressed into the target. Once the syringe is emptied into the target, in some embodiments the projectile assembly 150 may fall away from the animal; in other embodiments, the assembly 150 may remain in the animal for a period of time, then fall away. In still other embodiments, the projectile assembly 150 (or parts thereof) may stay with the target for longer or shorter periods.

Upon impact, a cone assembly 200 may increase the area over which kinetic energy from the projectile assembly 150 is transferred to the target. For example, the projectile assembly may include a deformable plastic or foam body that carries one or more cannula. Upon firing, the deformable cone assembly 200 may compress to conform to various smooth-bore barrel configurations. For example, a some shotguns include a choke tube (e.g., full, modified, improved, etc.) or may include a plurality of non-parallel barrels. The deformable cone assembly may conform to these various barrel configurations as it travels down the barrel. Upon impact, the cone assembly may deform and spread the kinetic energy of the projectile assembly 150 into an area of the target as the cannula enter the target to deliver the payload. In some embodiments, the force of impact renders the cone assembly unusable.

Referring to FIGS. 2A-F, one embodiment of the cone assembly 200 may include a plurality of deformable sections 202 surrounding a core 204 having an axis A-A. While the drawing figures illustrate a cone having twelve sections 202, other embodiments may include fewer or more sections. The sections 202 may be flexibly joined about the axis A-A. The sections 202 may form the cone 200 as a single body having scoring indentations or as multiple bodies joined by joints 205 that allow the cone 200 to deform around the core 204 and the axis A-A.

In some embodiments, when the sections 202 are joined, the outside surface of the cone 200 may be shaped generally as a projectile having a conical portion or ogive 206 and a cylindrical portion 208. In other embodiments, a cone assembly 200 may be shaped to fit snugly in the barrel of a firearm upon firing. For example, immediately before curving down to the apex, the cone assembly may bulge outward to have a gentle contact with the inside diameter of the barrel to aid in guarding against rocking or wobble as the projectile assembly 150 moves down the barrel upon firing. Drawing FIGS. 5A-E illustrate embodiments of the projectile assembly with a bulging area in the cone assembly.

The outside surface of the cone 200 may be shaped generally as a projectile having a conical portion or ogive 206 and a cylindrical portion 208. The ogive 206 may include a fore-end ring 210 that is formed by the plurality of radially joined segment sections 202. In other embodiments, a separate fore-end sleeve 210B may be placed in a sealing relation to the cannula and connected to each section 202 via fore-end ring 210. The fore-end ring 210 may be adapted to fit in sealing relation against a corresponding sealing surface around a body fitted within the core 204 along axis A-A running from the cone assembly apex to a center of the cone assembly base. For example, the fore-end ring 210 may provide a seal around a cannula 302 of the syringe assembly 300 at an exit port 310 to prevent the payload from leaking from the syringe body 306 or pouch 360 (FIG. 3, described below). In some embodiments, tips of the sections 202 may collectively form the fore-end ring 210. In other embodiments, the fore-end ring 210 may be a separate element from the sections 202 (e.g., an o-ring, a gasket, etc.). In any event, when the cone assembly is "at rest" and in an extended first position, the fore-end ring 210 may provide a seal for the cannula 302 to prevent any liquid or other material inside the syringe assembly 300 from leaking out of the syringe assembly 300. The cone assembly 200 may begin with the ogive 206 and terminate at a cone base 211B. The cone base 211B may include a base ring 208B joining the base portion of the segments and may abut a hub/head assembly 304 of the syringe assembly 300.

Figure 2A:
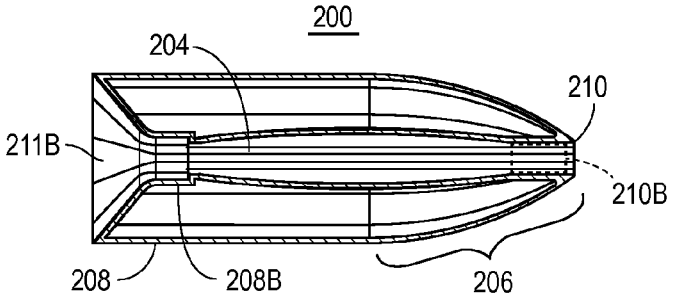
FIG. 2A is a sectional view of a cone assembly.
Figure 2B:
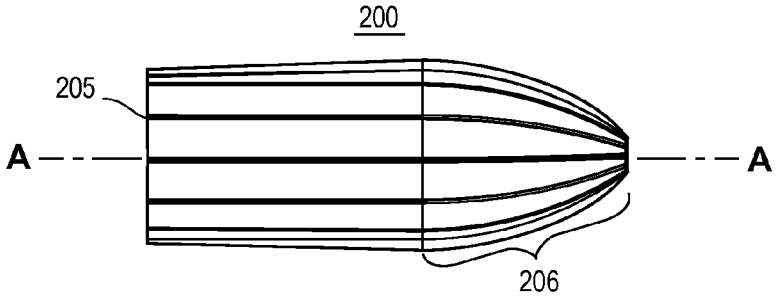
FIG. 2B is a side view of the cone assembly of FIG. 2A.
Figure 2C:
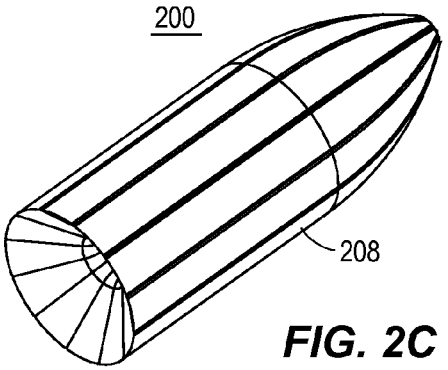
FIG. 2C is a rear perspective view of the cone assembly of FIG. 2A.
Figure 2D:
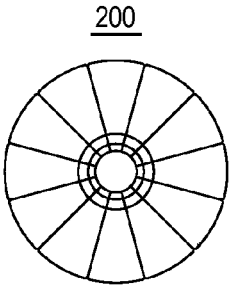
FIG. 2D is a rear view of the cone assembly of FIG. 2A
Figure 2E:
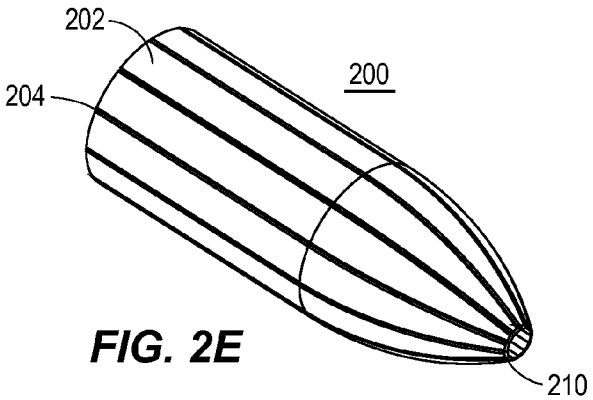
FIG. 2E is a front perspective view of the cone assembly of FIG. 2A.
Figure 2F:
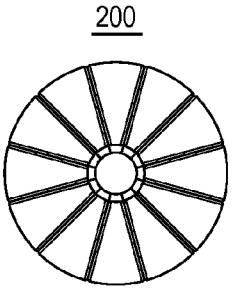
FIG. 2F is a front view of the cone assembly of FIG. 2A.
Figure 2G:
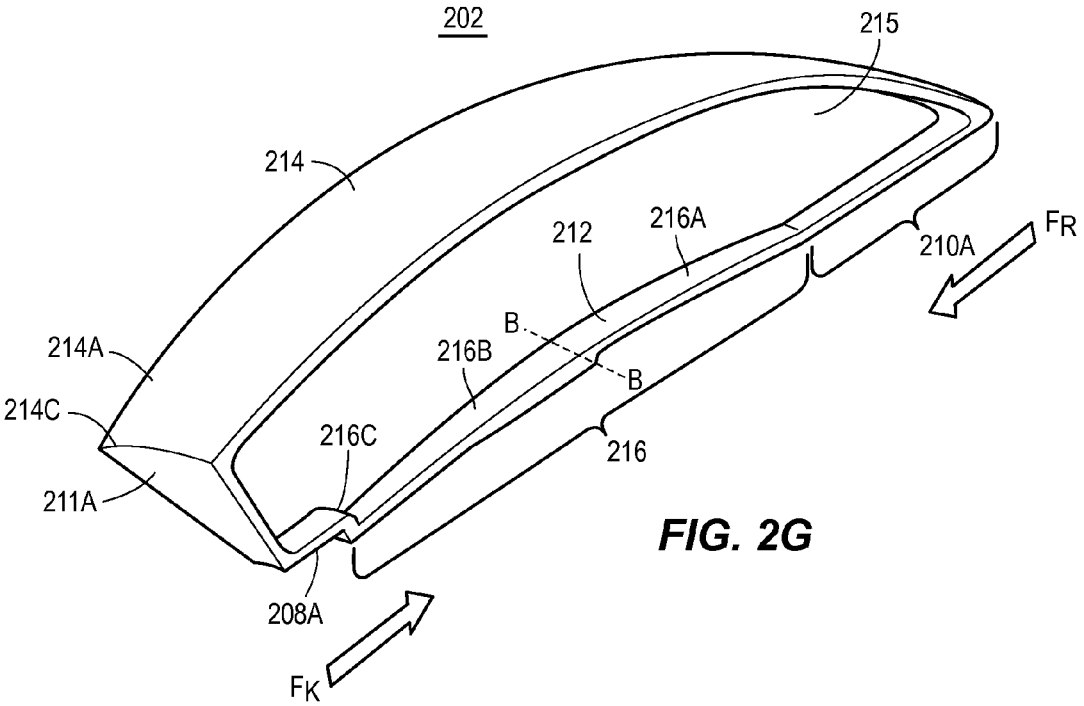
FIG. 2G is an "at rest" sectional view of a portion of the cone assembly of FIG. 2A.

FIG. 2G illustrates a cone section 202 when "at rest" (e.g., before the RTS impacts a target and the fore-end ring 210 is in an extended first position). The cone section 202 may include an inner rib 212 (i.e., a first portion) and an outer rib 214 (i.e., a second portion). The inner and outer ribs may surround a cone payload area 215. The cone payload area 215 may carry a marking dye or other payload. In some embodiments, the cone assembly 200 may carry an isotopic labeling compound. In response to impact with a target, the ribs 212 and 214 may shift around one or more pivots that connect the inner and outer ribs 212, 214 from an undeformed first position and a deformed second position. This shifting may also cause the fore-end ring 210 to shift along the longitudinal axis of the core 204 from an extended first position toward the base ring 208B in a retracted second position. This shifting may cause the joints 205 to open and any payload within the payload area to escape through the opened joints 205, thus marking the target. The cone payload area 215 may also carry the payload to a topical area of the target without penetration of the target surface. For example, the cone payload area 215 may carry a fluorescent or other high-visibility marking dye, an infrared marking liquid, a topical treatment, or other types of liquid or viscous payloads.

The inner rib 212 may include a fore-end ring section 210A, and an inner rib hinge section 216. The fore-end ring section 210A may form a portion of the fore-end ring 210 when formed with any remaining sections 202 to make a complete cone 200 around the core 204. Similarly, a base ring section 208A of the inner rib 212 may form a portion of the base ring 208B when formed with any remaining sections 202 to make a complete cone 200. The inner rib hinge section 216 may include a leading inner arm 216A and a trailing inner arm 216B that terminates at an inner rib hinge base 216C. In a preferred embodiment, the inner rib hinge 216 section may curve into the cone payload area 215 toward the outer rib 214. For example, the leading inner arm 216A may curve toward the outer rib portion 214 until it reaches axis B-B, then the trailing inner arm 216B may curve away from axis B-B and the outer rib portion 214 until it terminates at the inner rib hinge base 216C. In other embodiments, the leading inner arm 216A may have no curve and follow the axis A-A along the core 204, or may curve out from the cone payload area 215 toward the core 204 and away from the outer rib 214. The inner rib hinge base 216C may be formed by an overlap area with the trailing inner arm 216B along a longitudinal axis of the inner rib 212. The outer rib 214 may include an outer rib arm 214A and a cone base section 211A joined at an outer rib knuckle 214C. The outer rib 214 may join the inner rib 212 at the inner rib hinge base 216C and the fore-end ring section 210A.

Figure 2H:
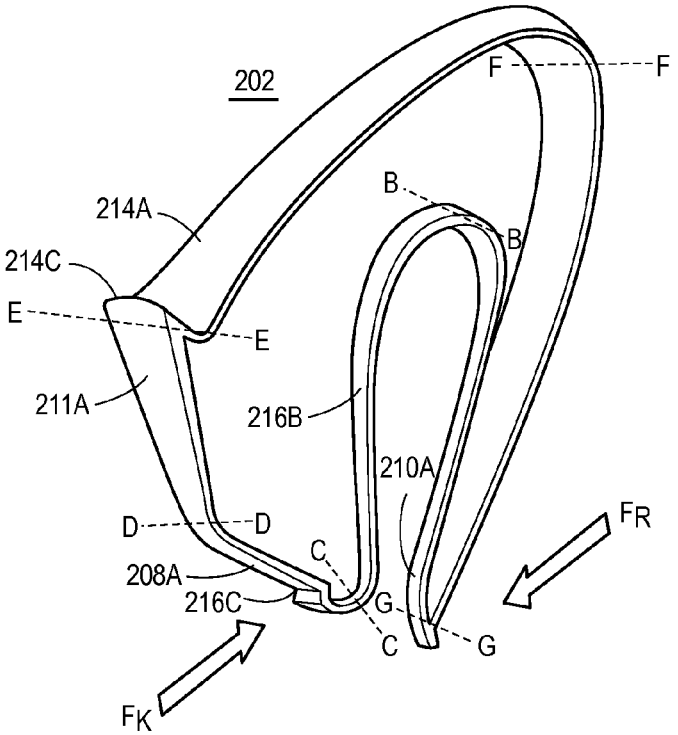
FIG. 2H is a "deformed" sectional view of the cone assembly of FIG. 2G.
Figure 2I:
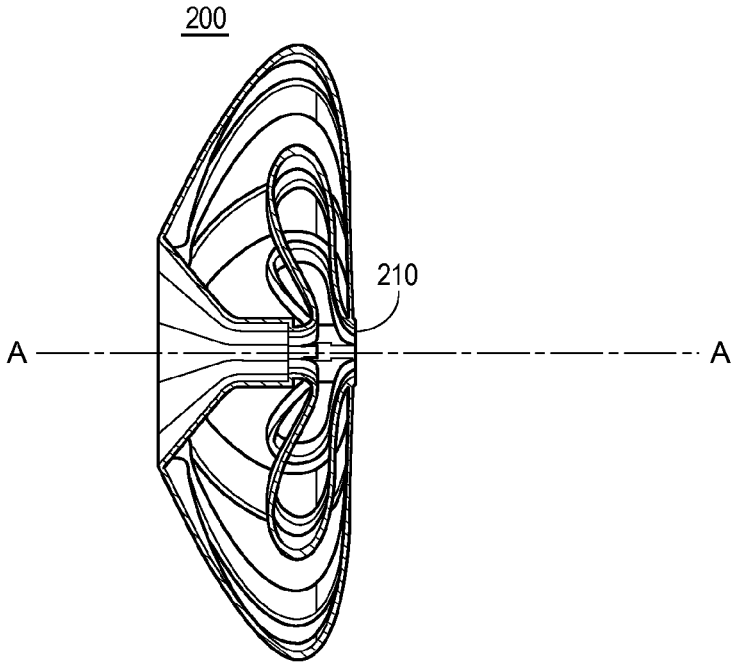
FIGS. 2I and 2J are sectional and side views, respectively, of the cone assembly of FIG. 2A after deformation in response to an impact between the cone assembly and a target.
Figure 2J:
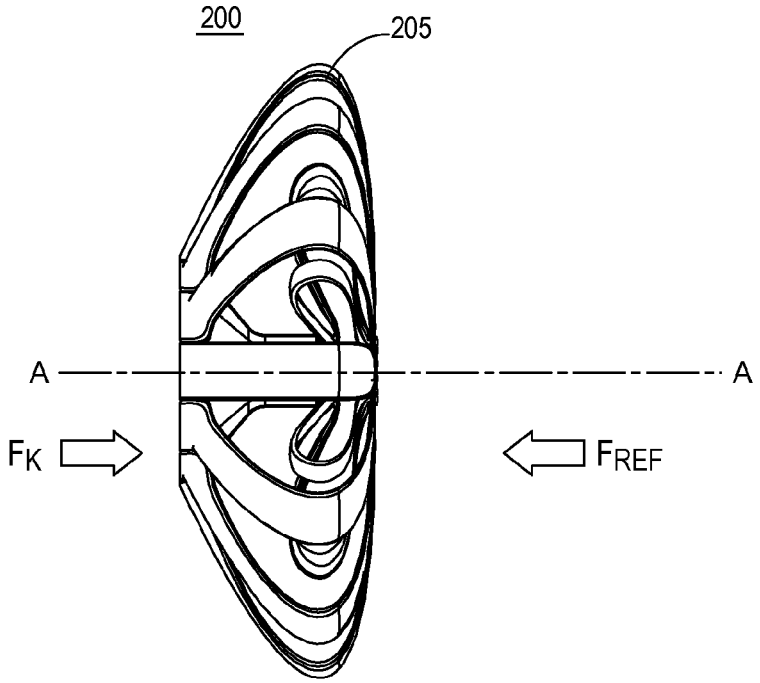
Figure 2K:
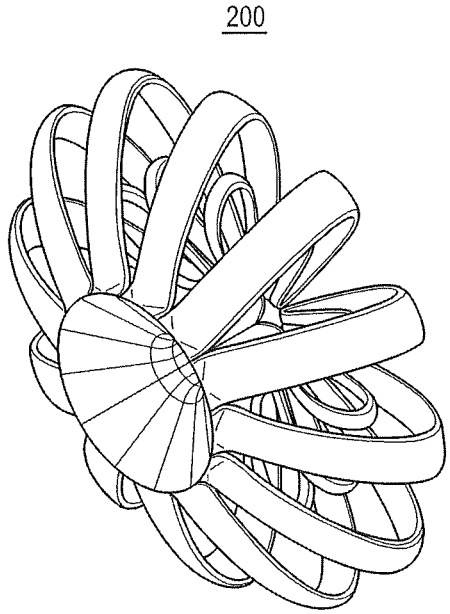
FIG. 2K is a rear perspective view of the cone assembly of FIGS. 2I and 2J after deformation in response to an impact between the cone assembly and a target.
Figure 2L:
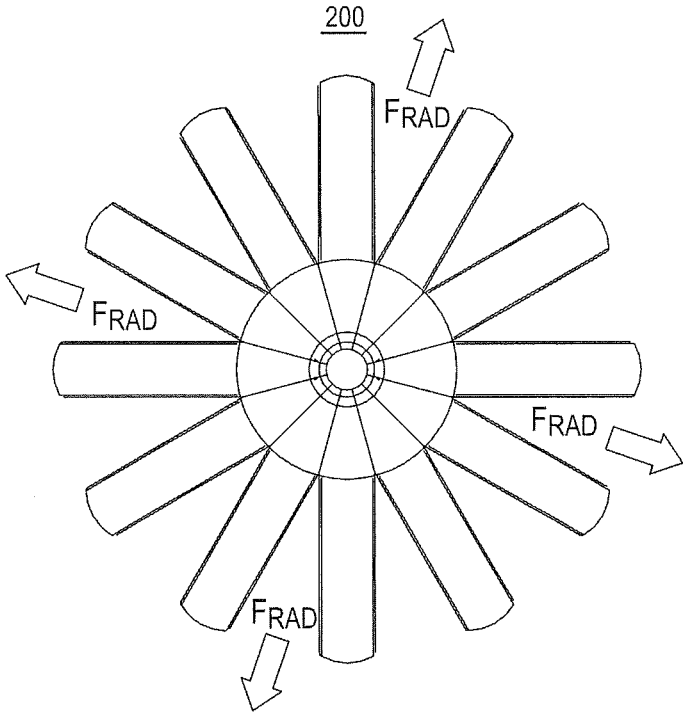
FIG. 2L is a rear view of the cone assembly of FIG. 2K.
Figure 2M:
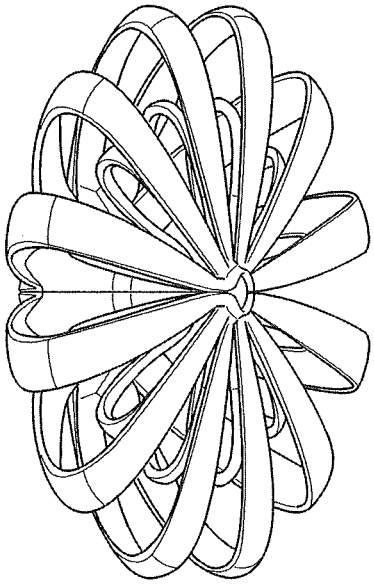
FIG. 2M is a front perspective view of the cone assembly of FIG. 2K.
Figure 2N:
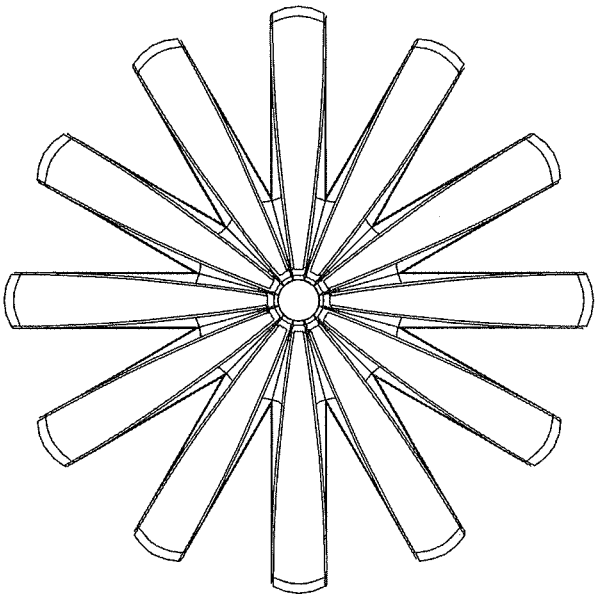
FIG. 2N is a front view of the cone assembly of FIG. 2K.

FIG. 2H illustrates a cone section 202 when deformed after impact with a target and shows the fore-end ring 210 in a retracted second position. The kinetic energy of the projectile assembly 150 in flight ($F_K$) is transferred through the projectile assembly 150 to the target along axis A-A and causes the cone assembly to pivot from an undeformed first position and a deformed second position. As some of the projectile assembly's kinetic energy is reflected from the target back toward the projectile assembly ($F_{REF}$), the fore-end ring section 210A and the cone base section 211A shift toward each other due to the inner rib 212 and outer rib 214 shifting about a plurality of pivots within each cone assembly section 202. In response to impact, the forces deform each cone section 200 radially outwardly from a center of the fore-end ring 210 and around a pivot defined by axis A-A. The inner and outer ribs may deform radially away from the core 204 center and a pivot defined by axis A-A as the forces move the fore-end ring section 210A and the cone base section 211A toward each other along the core 204. The impact forces may generally cause the leading inner arm 216A and the trailing inner arm 216B to shift toward each other around a pivot defined by axis B-B, the trailing inner arm 216B and inner rib hinge base 216C to deform toward each other around a pivot defined by axis C-C, the inner rib hinge base 216C and the cone base section 211A to deform away from each other around a pivot defined by axis D-D, the cone base section 211A and the leading outer arm 214A to deform away from each other at a pivot defined by axis E-E, the leading outer arm 214A to deform at a pivot defined by axis F-F, and the leading outer arm 214A to deform toward the fore-end ring section 210A at a pivot defined by axis G-G. One or more of the inner and outer arms may include structures along one or more of the axes A-A through G-G that cause the cone 200 to remain deformed after it impacts the target. For example, the cone 200 may include scoring along the axes that permits the cone to further break apart in response to impact.

FIGS. 2I-2N illustrate the cone assembly 200 after impact with a target and deformation of each cone section 202. As shown, impact may impart forces along the axis A-A and drive the fore-end ring 210 and the cone base section 211A toward each other and into a retracted second position. In doing so, the impact forces also cause the joints 205 to separate as the surface of the cone assembly 200 is subjected to radial forces ($F_{RAD}$) perpendicular to the axis A-A resulting from compression of the cone assembly 200 during impact.

Figure 2O:
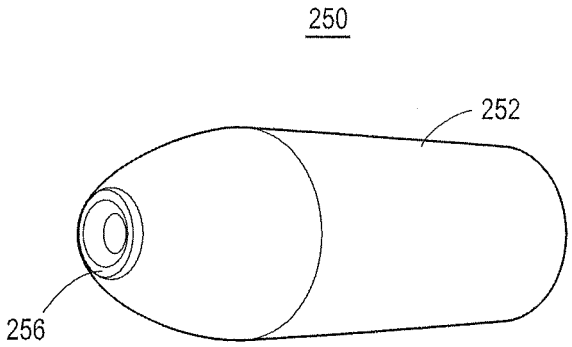
FIG. 2O is a front perspective view of an alternative embodiment of a cone assembly.
Figure 2P:
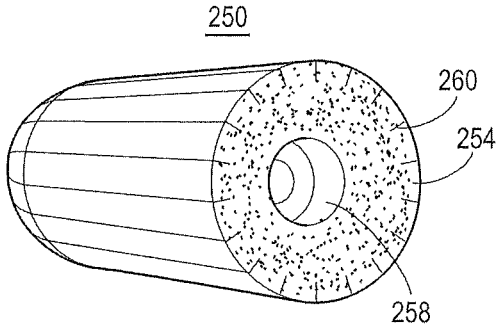
FIG. 2P is a rear view of the alternative embodiment of the cone assembly of FIG. 2O.
Figure 2Q:
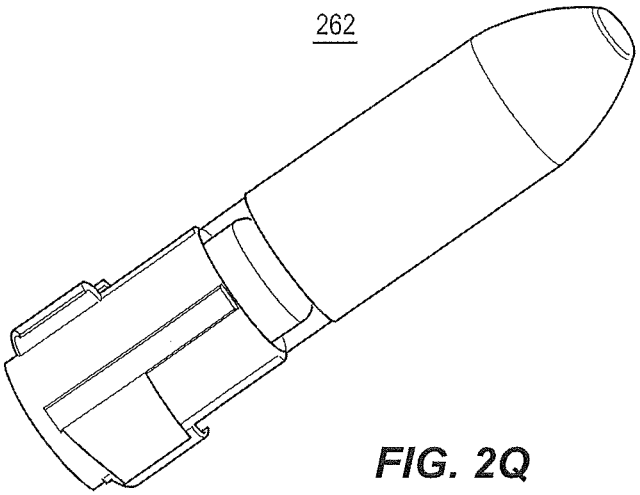
FIG. 2Q is a side view of a projectile assembly of a remote treatment system with the alternative embodiment of the cone assembly of FIG. 2O.

FIGS. 2O-2Q illustrate an alternative embodiment of the cone assembly 200. A foam cone may be formed of a solid, spongy, cellular material, such as polyurethane, for example. In some embodiments, the foam cone 250 is constructed from a polyester resin and catalyst in the presence of a gas such as carbon dioxide. The foam cone 250 may be shaped to a bullet shape, similar to the cone assembly 200. An outer surface (i.e., a first portion) 252 of the foam cone 250 may be treated such that the cellular structure of the foam cone interior (i.e., a second portion) 254 is concealed. Sealing or otherwise treating the outer surface 252 of the foam cone 250 may also improve the ballistic profile of the foam cone 250 over a cone with an exposed cellular structure.

The foam cone 250 may include a fore-end ring 256 and a base ring 258, which collapse toward each other around a pivot as a result of impact forces from an undeformed first position and a deformed second position. The internal cellular structure of the foam cone 250 may also hold a liquid or other payload similar to the payload carried by the cone 202, as described above.

The cone surface 252 may also include slots 260. The slots may be molded or cut into the foam. The slots 260 may allow the foam cone 250 to spread upon impact to lower the amount of kinetic energy transferred from the projectile assembly 262 to the target. The slots 260 may also allow the payload carried within the foam cone's internal cellular structure to be released from the core and onto the target upon impact.

Figure 3A:
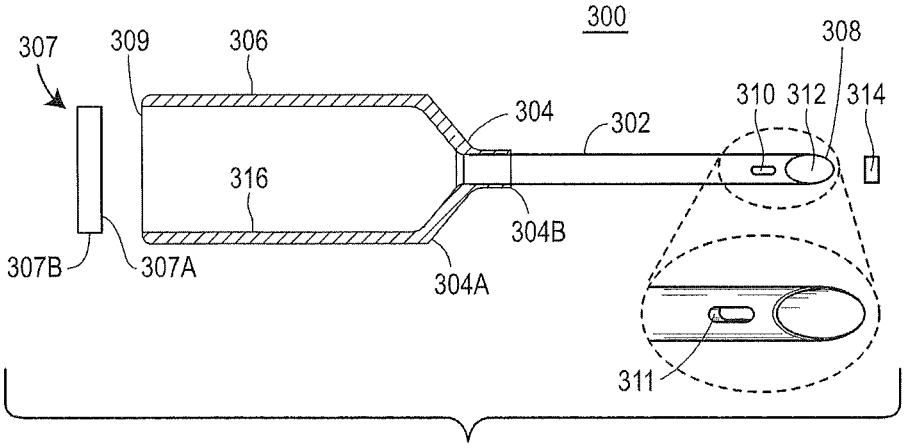
FIG. 3A is a side view of a syringe assembly.
Figure 3B:
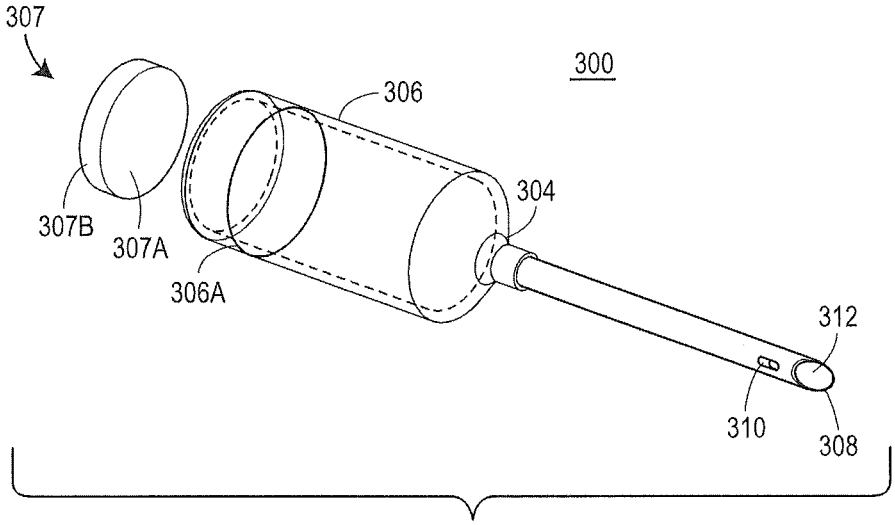
FIG. 3B is a front perspective view of the syringe assembly of FIG. 3A.
Figure 3C:
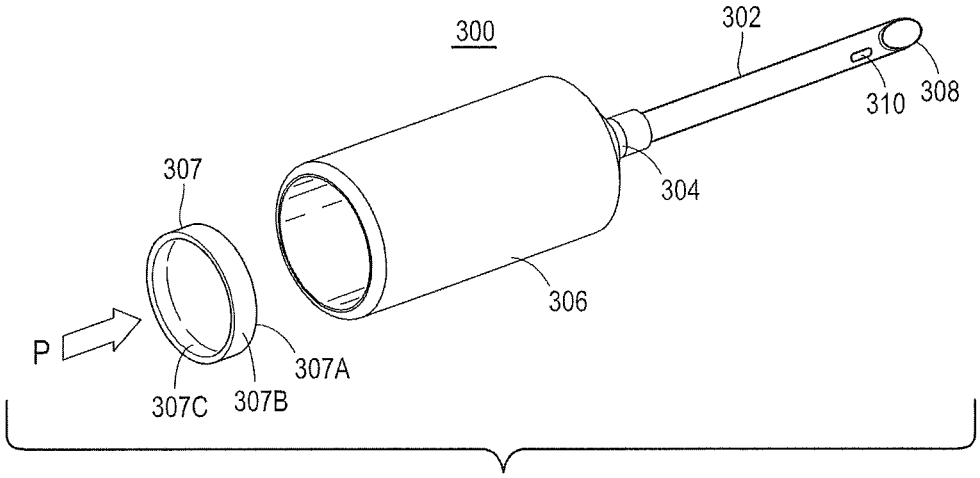
FIG. 3C is a rear perspective view of the syringe assembly of FIG. 3A.

FIGS. 3A-3C illustrate a payload or syringe assembly 300. The payload assembly 300 may include an implantable payload such as a satellite or radio tracking and information or data harvesting systems (e.g., a global positioning system (GPS) locator, an IRIDIUM satellite constellation or other satellite system, link microchip, a radio transmitter, a radio frequency identification chip, etc.). A syringe assembly 300 may include a needle or cannula 302, a hub/head 304, a hollow cylindrical barrel or body 306, and a plunger assembly 307. The cannula 302 may include a hollow or a solid bevel tip 308 and at least one exit port 310 located on a longitudinal side of the cannula. While the embodiment described is generally described as having one cannula, the syringe assembly 300 may include a plurality of cannulae. For example, a syringe assembly 300 for an intramuscular injection may include a single cannula 302, but a syringe assembly 300 for a subcutaneous injection may include a plurality of shorter cannulae. While FIGS. 3A-3C illustrate two oval-shaped exit ports 310, the cannula 302 may include any number of exit ports of various shapes and sizes (e.g., circular, square, etc.). Furthermore, the one or more exit ports 310 may also be shaped to include a baffle 311. The baffle 311 may direct a payload from the port 301 at a rearward acute angle in relation to the longitudinal axis of the cannula 302 and generally toward the hub/head 304. In any event, placement of the exit ports 310 may counteract a force that might act to push the syringe assembly 300 out of a target in reaction to the payload being expressed into the target. Furthermore, the solid bevel tip 308 may also facilitate puncturing the skin or hide of the target and, because the tip is solid, any hair or soft tissue fragments removed by the puncturing process are less likely to impede the flow of the payload upon impact than a typical front-ported cannula. Oval exit ports 310 may be approximately one to two millimeters at their widest diameter and one-half to one millimeter at their narrowest diameter. The cannula 302 may be approximately three centimeters in length, although many other lengths are possible in different applications of the RTS.

In other embodiments, the bevel 308 includes an opening 312, which may be closed with a bevel plug 314 once the syringe body 306 is filled. The bevel plug 314 may be made of a self-sealing material. The self-sealing bevel plug 314 may be adapted to fit in sealing relation against a corresponding sealing surface within the tip of the cannula 302. For example, the syringe body 306 may be filled by inserting a filling tube or other type of filling device though the bevel plug 314 where the filling device is a smaller gauge than the cannula 302. The payload of the filling assembly may then be expressed into the syringe body 306, and the filling assembly may then be removed from the bevel plug 314. In some embodiments, the syringe body 306 includes a payload volume of 4.5 to 10 mL; however the body may include various other payload volumes. For a 4.5 mL payload, a filler assembly may have a capacity of approximately 20 mL or more. The self-sealing bevel plug 314 may then seal the payload within the syringe body 306.

The hollow cylindrical body 306 may be constructed of clear polyurethane, latex, or other resin material to allow a user to see a fill level. The body 306 may include a hub/head or front end 304 and an open end 309 that oppose each other along the longitudinal axis of the syringe body 306. The hub/head 304 may be shaped as a cone conforming the to the cone assembly base 211B and include a base 304A having a diameter that conforms to the outer diameter of the hollow cylindrical body 306. The hub/head or front end 304 may also include a hollow cylindrical apex 304B having an inner diameter sized to receive an outer diameter of the cannula in a sealing relation. The outer diameter of the body 306 may be sized to fit in sealing relation against a corresponding sealing surface such as an inner diameter of the fins-cup assembly 400 (FIG. 4). The hub/head 304 may also be sized to receive the cone assembly base 211B. The base 211B and hub/head 304 may be affixed to each other in a sealing relation such that the cone assembly and syringe assembly remain connected during filling of the syringe body, fitting of the syringe to the fins-cup assembly 400, fitting of the completed projectile assembly 150 to the wad assembly 600 and shell 700, during flight of the projectile 150, and upon impact with a target. The body 306 may include a sealing ring 306A, may be sized such that an airtight seal exists between the inner diameter of the fins-cup assembly 400 (FIG. 4) and the outer diameter of the syringe body 306, or may be glued or sonically welded together, as described herein.

Kinetic energy or a pressure means may cause the payload to be expressed from the syringe assembly 300 in response to impact with a target. In some embodiments, kinetic energy may include the energy transferred to the payload in response to the projectile assembly's impact with a target while the pressure means may include one or more a pressurized fluid and a coil spring 307D (e.g., a conical coil spring as shown in FIG. 5C) that may provide a pressure P (FIG. 3C) against the payload to express the payload from the syringe body 306. Once the fore-end ring 210A slides below the exit ports 310 of the cannula as the cone assembly 200 deforms to the retracted second position in response to impact, the payload may be expressed from the exit ports 310 due to increased pressure within the syringe body 306 against the payload. For example, kinetic energy of the projectile assembly 150 during flight may be transferred to the payload in response to impact with a target. This kinetic energy may cause the increased pressure within the syringe body 306 to express the payload into the target. In another example, in response to impact with a target, a plunger assembly 307 may be moved from a rear opening of the syringe body 306 toward the hub/head 304. The plunger assembly 307 may include one or more of a plunger seal 307A and a cup 307B. While FIGS. 3A, 3B, and 3B show each of the seal 307A and cup 307B as approximately one-half of the entire plunger assembly 307, each of the seal 307A and cup 307B may be more or less of the entire assembly 307. For example, the seal 307A may be the top face of the cup 307B.

The plunger seal 307A may be adapted to fit in sealing relation against a corresponding sealing surface such as an inner wall 316 of the syringe body 306 to form a seal between the plunger seal 307A and an inner wall 316 of the syringe body 306. In some embodiments, the plunger seal 307A includes a rubber or plastic gasket. When the fore-end ring 210A slides from the extended first position past the exit ports 310 to the retracted second position in response to impact, a pressure against the plunger seal 307A may push the seal along the inside of the body 306 toward the cannula 302, allowing the syringe assembly 300 to express a fluid payload through the exit port 310. In some embodiments, kinetic energy during flight of the projectile assembly 150 may be transferred to the plunger assembly 307 upon impact with a target. The kinetic energy of the plunger assembly 307 may increase pressure against the payload and, once the fore-end ring 210A slides past the exit ports 310 to the retracted second position in response to impact, the pressure may release the payload through the exit ports 310. The kinetic energy may force the plunger assembly 307 from an opening of the syringe body 306 toward the hub/head 304 of the cannula 302 upon impact to increase the pressure of the payload within the body 306. In other embodiments, a plunger cup 307B may provide an enclosed or hollow area 307C behind the plunger seal 307A for a compressed fluid (e.g., a gas such as air or $CO_2$) or a coil spring 307D (shown in FIG. 5C). The coil spring 307D may be compression coil spring that is designed to resist being compressed. The compression coil spring 307D may also be conically-shaped. Either the wide or narrow portion of the conical spring 307D may abut the plunger assembly. The compressed gas or compressed coil spring may bias the plunger assembly against the payload to create a positive pressure within the syringe assembly 300.

As shown in FIG. 3C, pressure P exerted against the cup 307B biases the plunger assembly 307 toward the cannula 306. The pressure P may be applied by one or more of the kinetic energy, compressed fluid, and coil spring 307D. The pressure may also be created by a chemical reaction within the syringe body 306. For example, one or more capsules containing a chemical may break upon impact with the target and react with another chemical present in the body 306. The reaction may release a gas to pressurize the body. In some embodiments, the body 306 is constructed of a material including a chemical that reacts with the chemical present in the breakable capsule. For example, a syringe body made of a metal (e.g., zinc) may react with hydrochloric or sulfuric acid to produce hydrogen gas. Further, the pressure may be translated to the plunger seal 307A to create a positive pressure within the syringe body 306. The pressure P may be equalized within the syringe body 306 to express the payload through an exit port 310 when the fore-end ring 210A slides past the exit ports 310 to the retracted second position in response to impact. In some embodiments, one or more of the compressed gas and coil spring 307D may exert a pressure between 10 and 15 Newton-meters, or approximately 7.3 to 11 foot-pounds within the syringe body. This pressure may cause the payload to be expressed from the exit ports 310 with or without the assistance of the plunger assembly 307 and/or coil spring. When used with the plunger assembly 307, the pressure may bias the cup and plunger against the payload and to move the plunger assembly 307 down the syringe body 306 to express the payload through the one or more exit ports 310. Further, when the syringe assembly 300 and the plunger assembly are joined, the plunger seal 402 may be fitted within the body 306 against the payload to remove any air from within the syringe body 306 to eliminate any danger of an air embolism during deployment of the remote treatment system (RTS) 100.

Figure 3D:
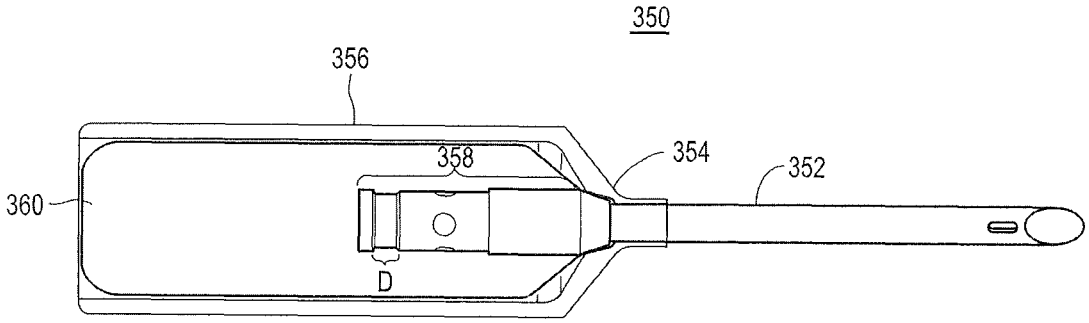
FIG. 3D is a side view of an alternative embodiment of a syringe assembly.
Figure 3E:
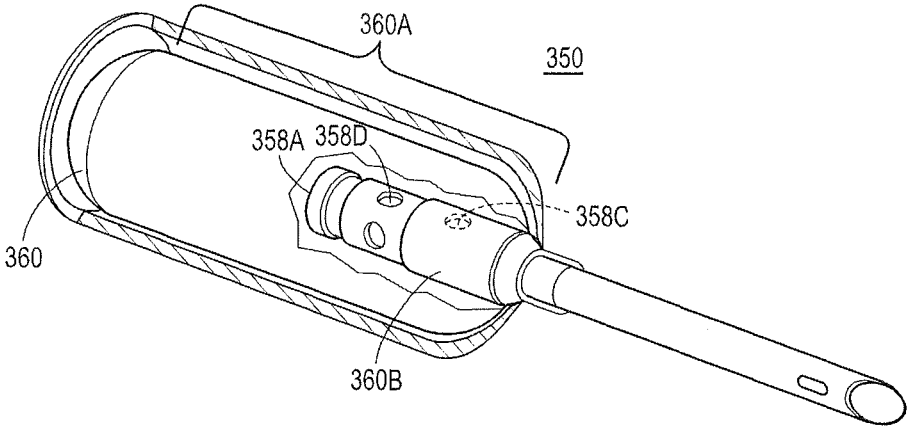
FIG. 3E is a front perspective view of the alternative embodiment of the syringe assembly of FIG. 3D.
Figure 3F:
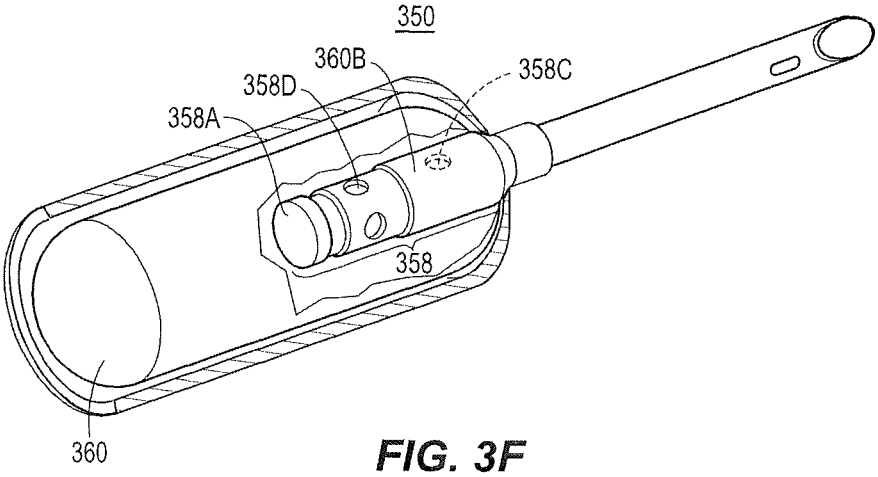
FIG. 3F is a rear perspective view of the alternative embodiment of the syringe assembly of FIG. 3D.

FIGS. 3D-F illustrate an alternative embodiment of a syringe assembly 350 including a needle or cannula 352, a hub/head 354, a barrel or body 356, a slider assembly 358, and a pouch 360. The slider assembly 358 may include a slider body 358A and a slider frame 358B. The slider frame 358B may be a hollow cylinder having inner diameters sized to receive the slider body 358A at one end of the slider frame 358B and the cannula 352 at the opposite end of the slider frame 358B. The slider body 358A and the slider frame 358B may each include a plurality of holes. The slider frame 358B may include a filling hole 358C and a purging hole 358D, while the slider body 358A may include a purging hole 358D. The pouch 360 may include a pouch body 360A and a pouch neck 360B. The pouch 360 may be made of latex, rubber, or other flexible material to act like a bladder or balloon to hold a payload within the syringe body 356. The pouch neck 360B may be stretched to fit over a portion of the slider assembly 358. In some embodiments, the pouch neck 360B is sized to fit in sealing relation against a corresponding sealing surface such as the cannula or a slider assembly 358. The pouch neck 3608 may be fitted over the filling holes 358C of the slider assembly 358 to create a seal between the filling holes 358C and the interior of the pouch body 360A and the interior of the cannula 352.

Figure 3G:
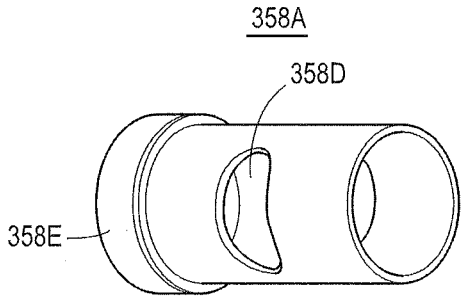
FIG. 3G is a front perspective view of a slider body.
Figure 3H:
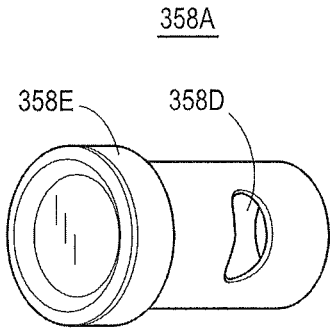
FIG. 3H is a rear perspective view of the slider body of FIG. 3G.
Figure 3I:
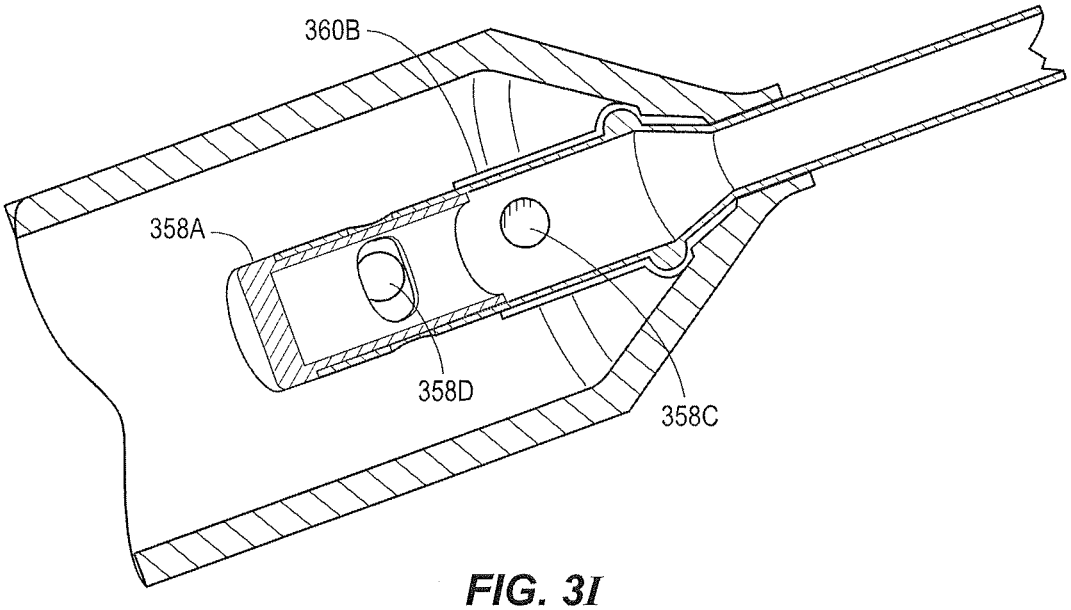
FIG. 3I is a sectional view of a portion of a syringe assembly that includes a slider assembly.

With reference to FIG. 3G, the slider body 358A may include one or more slider body purging holes 358D and a weight cap 358E. The slider body purging holes 358D may be positioned on the slider body 358A to close the slider assembly purging holes 358D in a closed first position and open the slider assembly purging holes 358D in an open second position. For example, FIGS. 3D-F illustrate the slider body 358A in a closed first position where the weight cap 358E is positioned a distance D from an opening of the slider assembly 358. In this first position, the slider body purging holes 358D are not aligned with the slider frame purging holes 358D. In contrast, FIG. 3I illustrates the slider body 358A moved to an open second position with the weight cap 358E positioned directly against the opening of the slider assembly 358. In this open second position, the slider body purging holes 358D are aligned with the slider frame purging holes 358D. In some embodiments, the slider body 358A may be moved into the open second position by the force of impact with a target. The weight cap 358E may be increased or decreased in size and weight to account for varying forces during firing and impact with the RTS 100 and to assure that the slider body 358A will move to the open second position in response to impact with a target.

While filling the pouch assembly, the slider body 385C may be positioned within the opening of the slider body assembly 358 such that the slider body purging holes 358D are not aligned with the slider frame purging holes 358D (e.g., the closed first position described above). During filling of the pouch assembly 360, a positive pressure at the slider assembly filling holes 358C behind the pouch neck 360B may be caused by a payload being forced into the cannula 352 and pushing through the filling holes 358C against the pouch neck 360B. Once the filling pressure exceeds the ability of the pouch neck 360B to maintain its seal between the filing holes 358C and the interior of the pouch body 360A, the payload may enter pouch body 360A. The pouch body 360A may be filled with a payload to a pressure that allows the payload to be purged from the body through the purge holes 358D in an even manner and into a target, while maintaining a seal over the filling holes 358C. In some embodiments, the pouch 360 may be filled to a pressure adequate to express the payload from the exit ports upon impact. The pressure within the pouch may be between 5 and 20 Newton-meters, or approximately 3 to 15 foot-pounds.

Where the syringe assembly includes the slider assembly 358 (e.g., FIGS. 3D-I), the bevel tip 362 of the cannula 352 may be hollow. Further, the sealing relation between the cone assembly fore-end ring 210 (FIGS. 2A-N) and the area of the cannula surrounding the exit port need not provide a seal barrier for the payload. In particular, when the pouch is filled, the pressure within the pouch body 360A and the seal between the pouch neck 360B and the filling holes 358C may keep any payload from leaking out of the cannula tip.

Furthermore, the cannula 302, 352 may include a floating assembly to seal the syringe body and payload from the cannula. A floating assembly may provide a seal between the cannula and the syringe body payload area. Upon impact, the cannula may be driven toward the syringe body, causing the cannula to pierce the seal. The payload may then be released into the target though the cannula. For example, a spring assembly may suspend the cannula 302, 352 a distance from the seal and the impact force may compress the spring, causing the cannula to pierce the seal.

In another embodiment, the syringe assembly may include a needleless syringe. For example, rather than expressing the payload through a cannula 302, 352, the payload may be expressed by compressed gas or other type of force into the target without a cannula. Where the target is an animal, the syringe assembly may express the payload as a high-pressure jet though the animal's hide without the aid of the cannula, as described above. In some embodiments, the needless syringe may employ a burst of high-pressure gas to propel the payload into the target. In other embodiments, the syringe may be equipped with a Lorentz-force actuator that may be tuned to control the depth of the injection into the target.

Figure 4A:
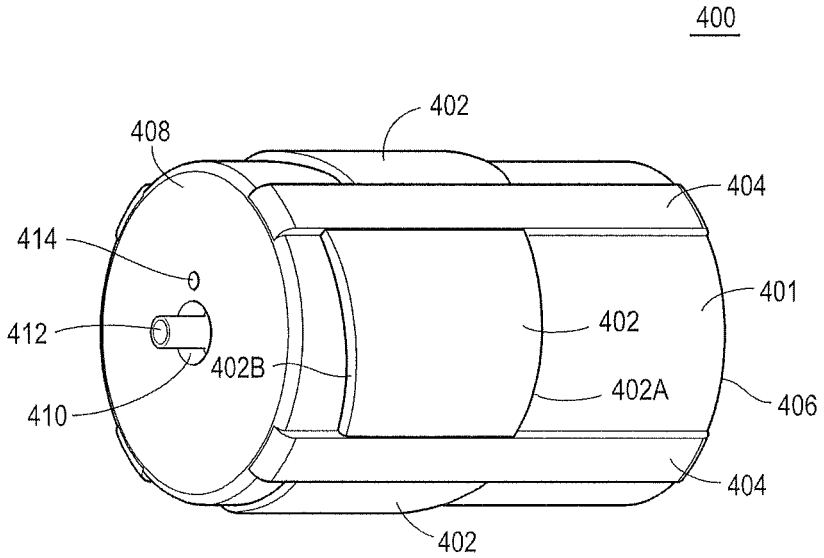
FIG. 4A is a rear perspective view of a fins-cup assembly with stowed stabilizing means.
Figure 4B:
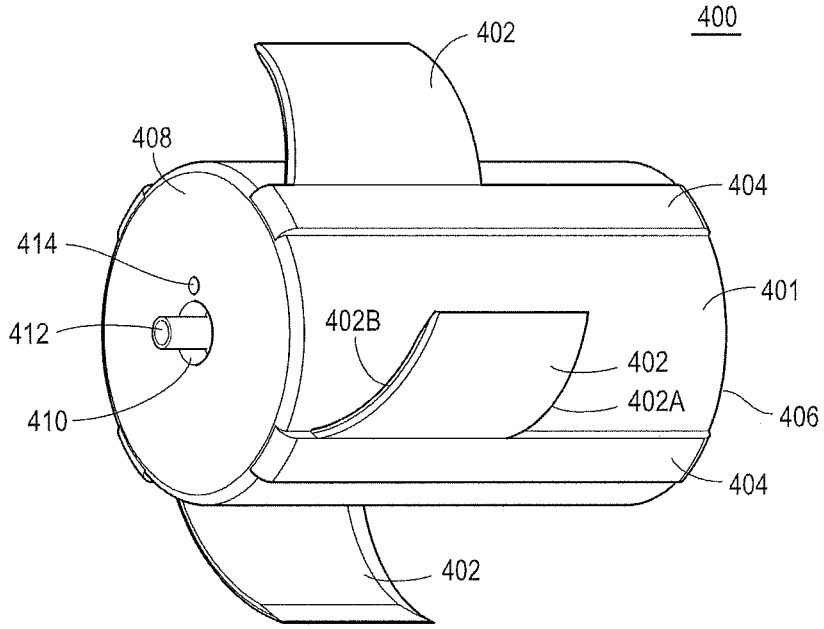
FIG. 4B is a rear perspective view of a fins-cup assembly with deployed stabilizing means.

FIGS. 4A and 4B illustrate one embodiment of a fins-cup assembly 400 that may be employed with the syringe assembly of FIGS. 3A, 3B, and 3C. The fins-cup 400 may include a hollow cylindrical body 401 and a stabilizing means 402. An inner diameter of the body 401 may be sized to receive one or more of the syringe open end and plunger assembly 307. In some embodiments, the hollow cylindrical body 401 may be sized to extend longitudinally along the syringe body 306 (FIG. 3A). For example, in various embodiments, the body 401 may extend anywhere from just beyond the syringe open end 306 to the base of the cone assembly 211B (FIG. 2A). In some embodiments, the stabilizing means includes a plurality of fixed fins or a plurality of hinged stabilizing fins 402, each of which is molded integrally with the fins-cup assembly 400 or molded separately and attached to a fins-cup rib 404. While the drawing figures illustrate a fins-cup 400 having four stabilizing fins 402 and ribs 404, the fins-cup 400 may include any number of fins 402 to stabilize the RTS 100 during flight to a target (e.g., two, three, etc.). The fins may each include a leading edge 402A, a trailing edge 402B, and a base 402C. The fins 402, ribs 404, and body 401 may be molded in a single piece or as separate components. At rest (i.e., before being pressed against the body 401 or during flight), the fins 402 may project outwardly from the fins-cup body 401. The fins 402 and ribs 404 may be sized and spaced around the fins-cup 400 such that, when the fins are pressed against the fins-cup body 401 (i.e., when the projectile assembly 150 is inserted within the wad 500), the fins 402 and ribs 404 present a smooth, uniform circumference around the fins-cup 400, as shown in FIG. 4A. The trailing edge of the fins 402 may be angled so that the fins-cup assembly 400 may be twisted to fit into the wad 600. In one embodiment, the bases 402C of the fins 402 are parallel to each other against their ribs 404 to prevent spinning of the projectile assembly 150 during flight. In another embodiment, the plurality of fin bases 402C are uniformly angled against their ribs 404 so that the projectile assembly 150 spins during flight.

The fins-cup body 401 may include an open end 406 and a closed end 408. The open end 406 may receive the syringe assembly 300 while the closed end 408 may include a filling valve 410. The filling valve may be molded integrally with the fins-cup body 401 or may be a separate element that is fixed in a sealing relationship to the closed end 408. The filling valve 410 may include a valve body 410A and a valve stem 410B. In some embodiments, the valve 410 includes a poppet valve that may operate using an axial force against the valve stem 410B to allow a fluid (e.g., a gas such as air or $CO_2$) to enter into the interior of the fins-cup body 401. The closed end 408 may also include a release valve 414. The release valve 414 may release any pressure over an amount required to move the plunger assembly 307 down the syringe body 306 to express the payload from the exit ports 310 upon impact (e.g., 10 to 15 Newton-meters or approximately 7.3 to 11 foot-pounds). In some embodiments, pressure exerted by a gas entering the valve 410 may provide a force within a volume bounded by the fins-cup closed end, the fins-cup body, and the plunger assembly. The force may bias the plunger assembly 307 against the payload within the syringe body 306 so that the payload may be expressed from the syringe body 306 once a seal (i.e., the fore-end ring 210A) slides from the extended first position along the cannula 302 toward the hub/head 304 to the retracted second position and is no longer in a sealing relation to the exit ports 310 in response to impact. To inject a gas or other pressurized fluid through the valve 410, the valve stem 412 may be fitted with a compact bicycle tire pump, a carbon dioxide cartridge, one or more pills or capsules containing a chemical that may break upon impact to react with another chemical to form an expanding gas within the syringe body, or other device. In embodiments that do not include the plunger assembly 307, the valve 410 may be a one-way valve to prevent any payload within the syringe body 306 from leaking, but allow air to enter the body 306 to allow the payload to be expressed from the body 306 through the exit ports 310.

Figure 4C:
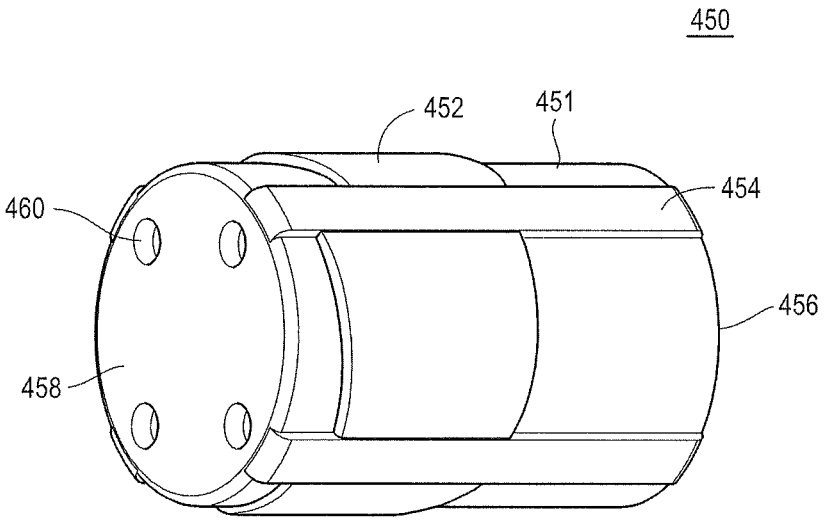
FIG. 4C is a rear perspective view of an alternative embodiment of a fins-cup assembly with stowed stabilizing means.
Figure 4D:
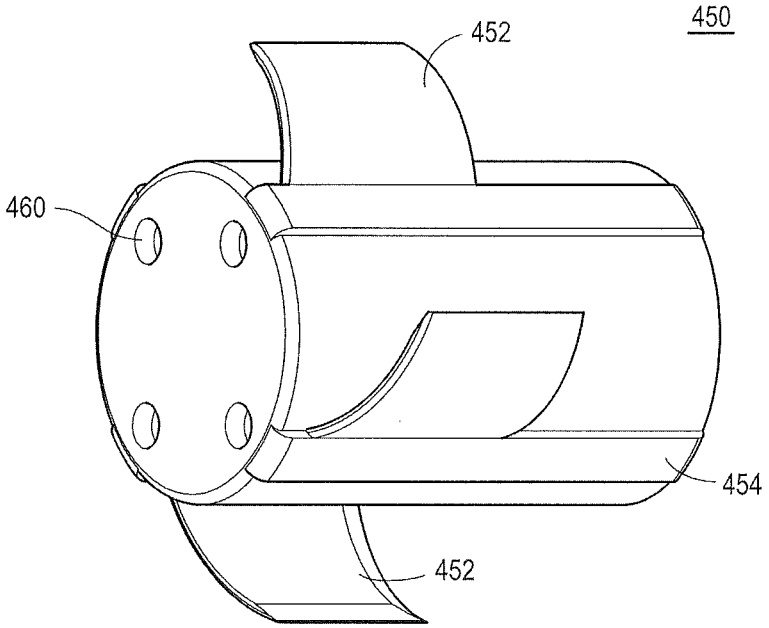
FIG. 4D is a rear perspective view of an alternative embodiment of a fins-cup assembly with deployed stabilizing means.

FIGS. 4C and 4D illustrate an alternative embodiment of the fins-cup assembly 450 that may be employed with the syringe assembly of FIGS. 3D-I. The fins-cup 450 includes a body 451 and a plurality of hinged stabilizing fins 452, each of which is attached to a fins-cup rib 454. The fins-cup body 451 may include an open end 456 and a closed end 458. The closed end 458 may include one or more vent holes 460. When joined, the fins-cup 450 and syringe body 356 form an air-tight seal. The vent holes 460 may allow the pouch 360 of the syringe assembly 350 to expand and contract within the syringe body 356 as the payload enters and exits the syringe assembly 350.

Figure 5A:
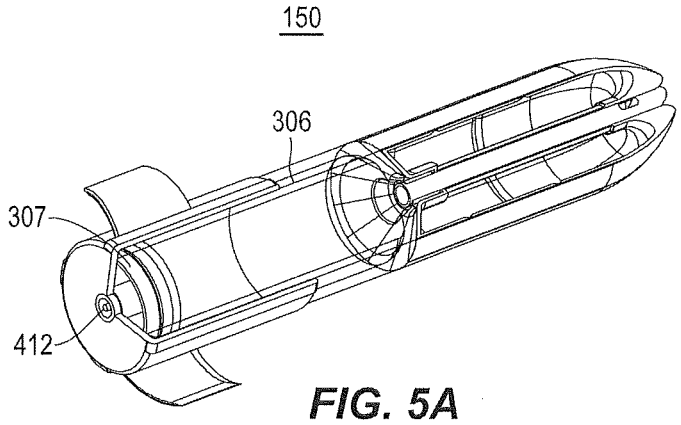
FIGS. 5A-E illustrate perspective views of various embodiments of the projectile assembly.
Figure 5B:
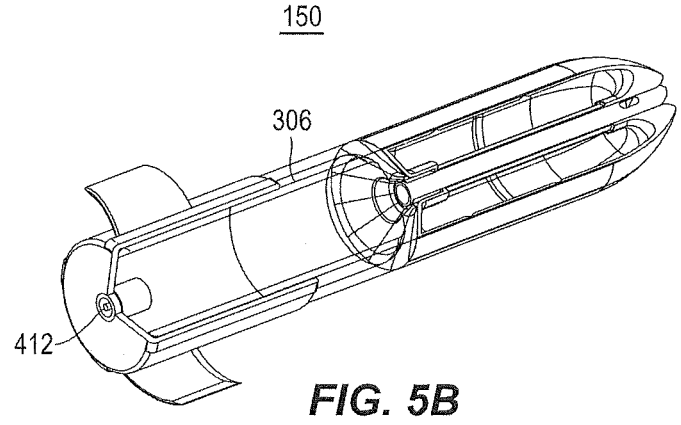
Figure 5C:
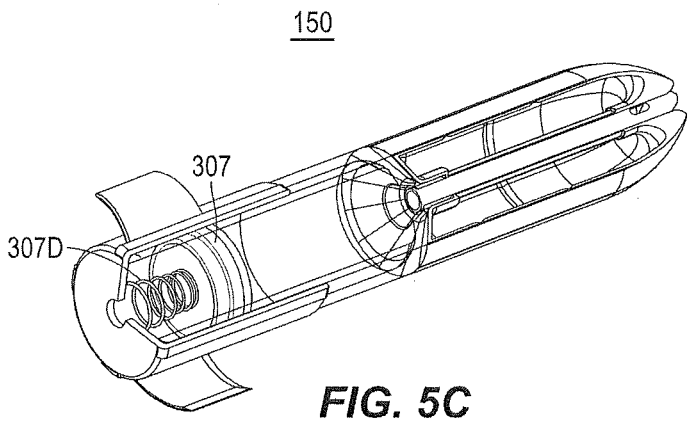
Figure 5D:
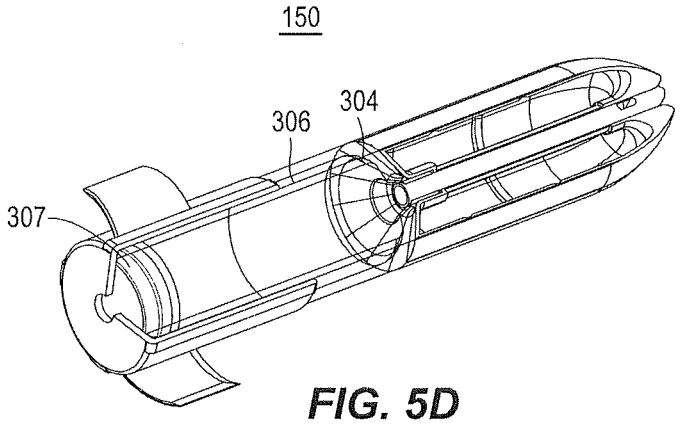
Figure 5E:
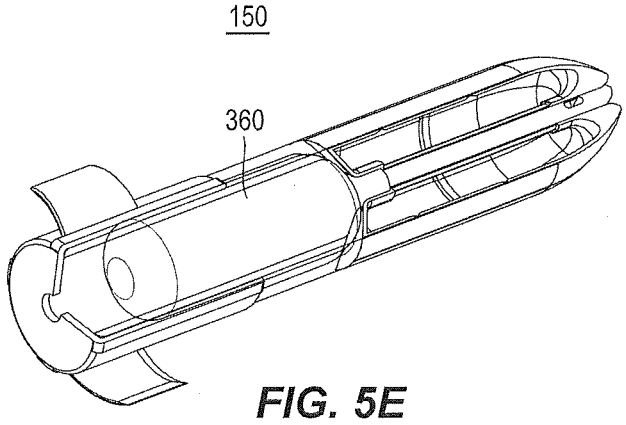

FIGS. 5A-E illustrate various embodiments of the projectile assembly as herein described, with different components to express the payload from the cannula upon impact with a target. FIG. 5A illustrates a projectile assembly having a valve 412 and plunger assembly. As described above, the valve may be used to introduce a gas (e.g., air, $CO_2$, etc.) behind a plunger assembly 307 (FIG. 3) to increase pressure within the syringe body 306. FIG. 5B illustrates a projectile assembly having a valve 412 without any plunger assembly. The valve 412 may be used to introduce a gas to increase a pressure within the syringe body and express the payload from the cannula upon impact. FIG. 5C illustrates a projectile assembly including a plunger assembly 307 and coil spring 307D. The spring may bias the plunger assembly within the syringe body against the payload to also increase a pressure within the syringe body and express the payload from the cannula upon impact. FIG. 5D illustrates a plunger assembly 150 having a plunger assembly 307 within the syringe body 306. Upon impact, the momentum of the plunger assembly 307 within the syringe body 306 may cause the plunger assembly 307 to move toward the hub/head 304. Movement of the plunger assembly 307 upon impact may increase a pressure within the syringe body and express the payload from the cannula upon impact. FIG. 5E illustrates a projectile assembly 150 having a pressurized pouch assembly 360 and slider assembly 358 (not shown in FIG. 5E, see FIG. 3D-I). Upon filling the pouch assembly, the sealed pouch assembly 360 may have a positive pressure compared to the atmospheric pressure surrounding the projectile assembly 150. Upon impact, the slider body 358A moves forward within the slider frame 358B and the payload is expressed though the cannula by the positive pressure.

Figure 6:
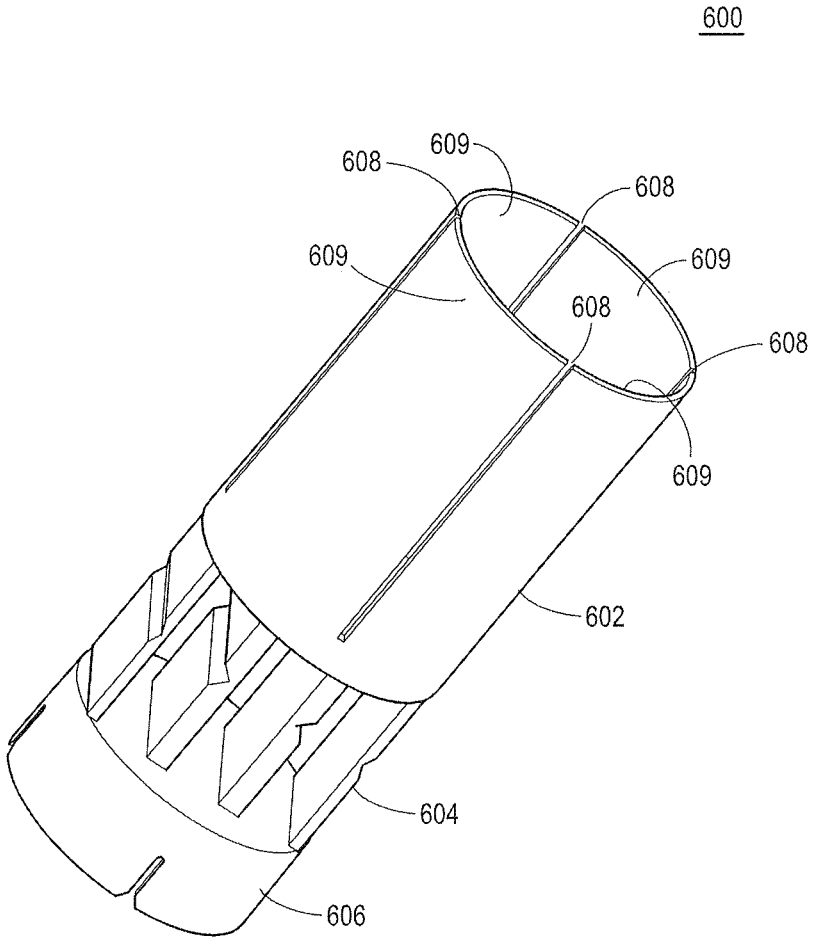
FIG. 6 illustrates a wad assembly.

FIG. 6 illustrates a wad assembly 600 into which the projectile assembly 150 may be fitted. The wad assembly 600 may include a skirted or non-skirted wad. In some embodiments, the wad assembly 600 may include a casing 602 and a wad 604 with skirts 606. When fitted to the projectile assembly 150, the wad casing 602 may extend along a length of the projectile assembly 150 to stabilize the projectile assembly as it travels along the length of the firearm barrel upon firing. The wad 600 may include an opening having an inner diameter sized to receive an outer diameter of fins-cup assembly 400, 450 in a sealing relation. In some embodiments, the wad casing 602 may extend to any point along the projectile assembly 150 from the fins-cup assembly closed end 408, 458 to the ogive of the cone assembly 200 or beyond. The wad assembly 600 may be made of a resin such as polyurethane or other type of flexible plastic material. For varying ranges of the RTS 100, the wad 600 may be made with materials of varying rigidity. For example, a longer-range RTS 100 may require a highly rigid wad to ensure most of the charge energy is transferred to the projectile assembly 150. While the wad assembly 600 shown in FIG. 6 includes a skirted wad 604, other types of wads may be employed (e.g., a fiber, felt, or cardboard disk, nitrocellulose, etc.). The wad assembly 600 also includes slits 608 which define wad sections 609 which aid in releasing the projectile assembly 150 from the wad assembly 600 by expanding and increasing the air resistance of the wad assembly 600 over the projectile assembly 150 once the wad carries the projectile assembly 150 out of the firearm barrel.

Figure 7:
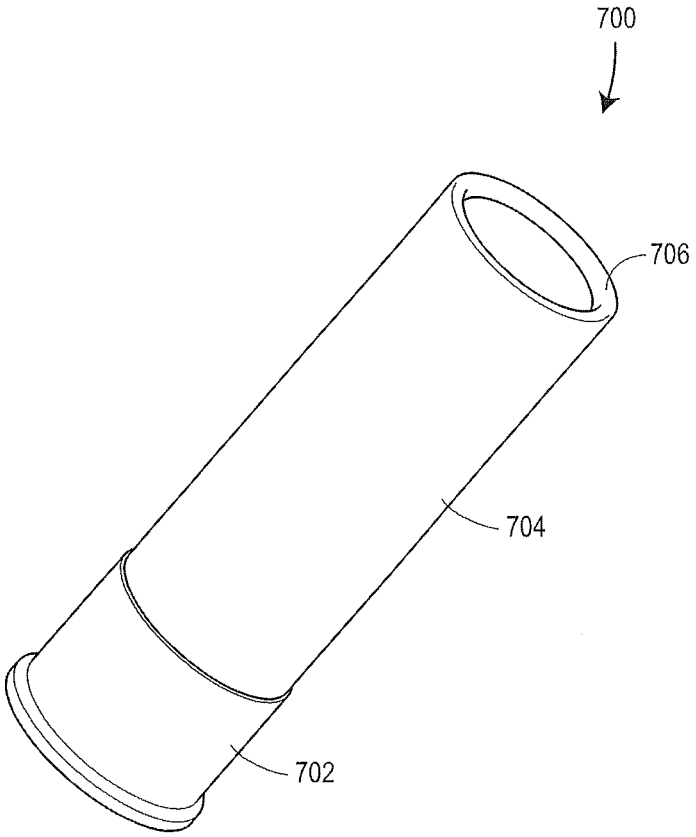
FIG. 7 illustrates a shell.
Figure 8A:
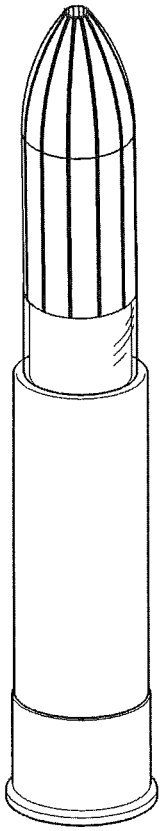
FIGS. 8A, 8B, and 8C illustrate various sizes of a remote treatment system.
Figure 8B:
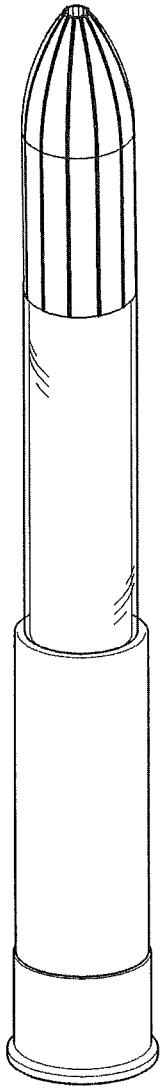
Figure 8C:
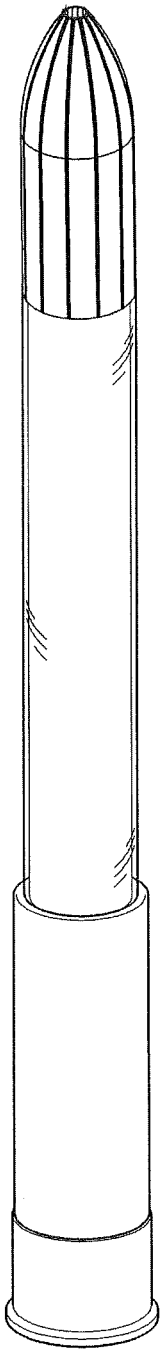

FIG. 7 illustrates a shell 700 including a head 702 and a case 704. The case 704 includes a seal 706 which holds the wad 700 in place inside the shell 700. The shell 700 may include a standard 2.75 inch shell, or a longer 3 or 3.5 inch shell, or longer lengths to accommodate various length projectile assemblies. In some embodiments, the seal 706 includes a roll crimp 606 that includes a portion of the case 704 that is formed into a roll covering a leading edge of the wad 600. In other embodiments, the seal 706 may include a fold crimp or other method of holding the wad assembly 600 within the case 704. The head 702 may include a charge that, using the firearm, is ignited by a primer. The amount of charge may vary according to the distance and type of projectile assembly 150. In some embodiments, the head 702 may be a "half-head" type. For example, as shown by FIGS. 8A-C, a syringe body 306 may be extended to hold varying amounts of payload that require more or less energy and, thus, charge for the projectile assembly 150 to reach the target. The size of the charge may be adjusted to achieve a flight speed of the projectile that is less than the speed of sound (i.e., 348.2 m/s at sea level) with the range of the projectile assembly 150 being between 10 and 200 meters. However, embodiments of the projectile assembly 150 as herein described may be used with a charge to achieve greater velocities (e.g., supersonic) and, thus, a greater range.

Figure 9:
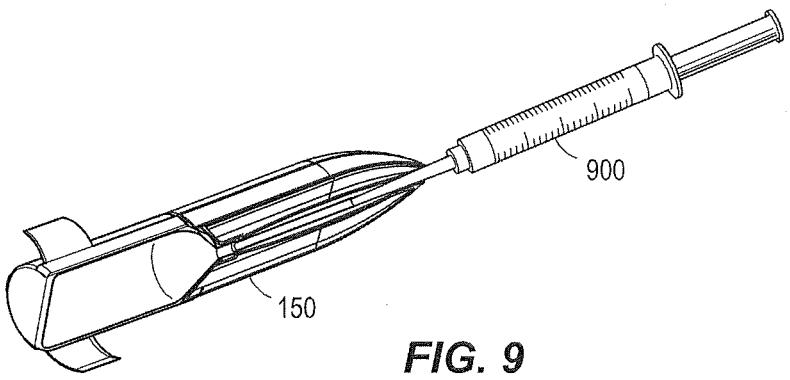
FIG. 9 illustrates a projectile assembly and a needleless syringe during filling of a payload area of the remote treatment system.
Figure 10:
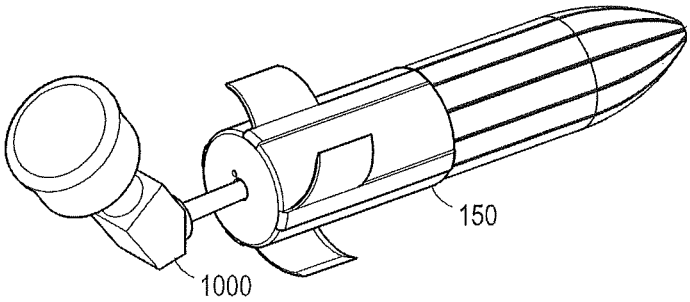
FIG. 10 illustrates a projectile assembly and a pump.
Figure 11:
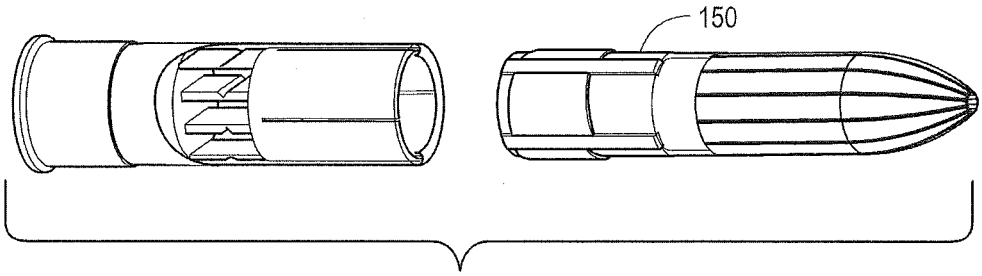
FIG. 11 illustrates a projectile assembly with stowed stabilizing means and a shell.

FIGS. 9-15 illustrate preparation and deployment of the RTS 100. With reference to FIG. 9, a user may compress the cone assembly 200 so that the fore-end ring 210 unseals and exposes the exit port 310. During use, the deformable cone assembly may: a) seal the cannula exit ports, b) deform for filling by moving the fore-end ring toward the hub head to unseal the exit ports, c) reseal by allowing the fore-end ring to spring back toward the bevel tip, d) stay sealed for at least twenty four hours as pressure tries to push the payload out past the exit ports (for the syringe assembly illustrated by FIGS. 3G-I), e) open from the impact kinetic energy that is greater than the pressure that it was able to resist, and f) stay open while the payload is expressed into the target.

Figure 12A:
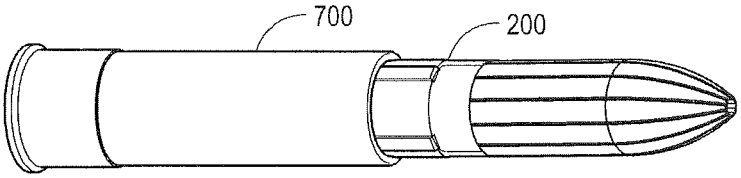
FIGS. 12A and 12B illustrate embodiments of a projectile assembly joined with a shell.
Figure 12B:
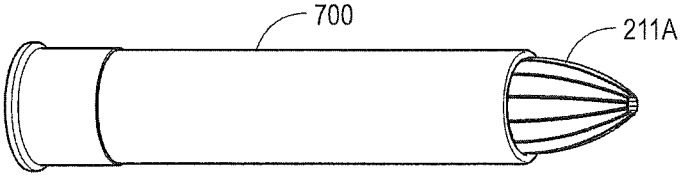
Figure 13:
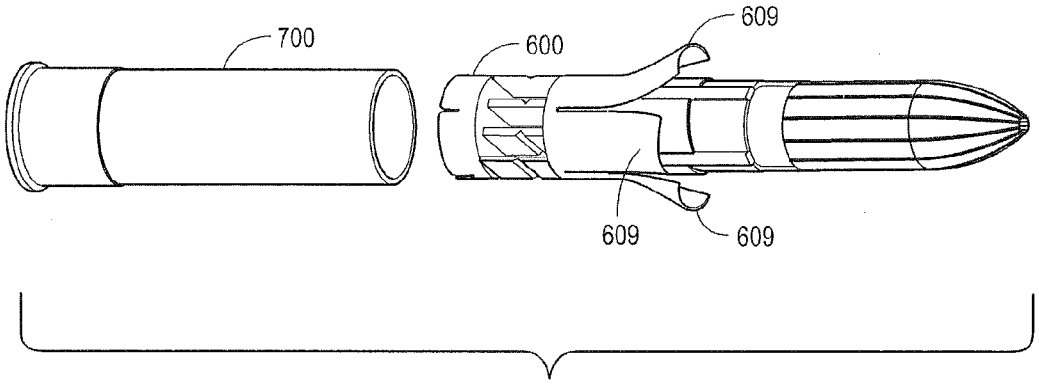
FIG. 13 illustrates a remote treatment system upon firing.
Figure 14:
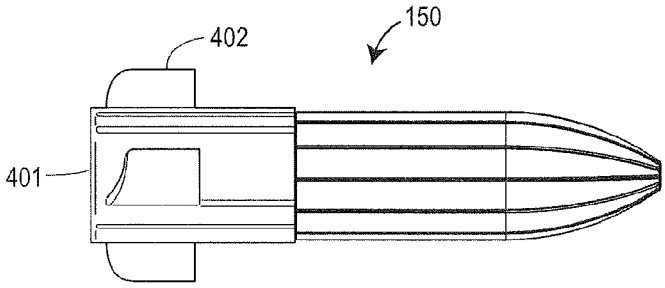
FIG. 14 illustrates the projectile assembly during flight.
Figure 15:
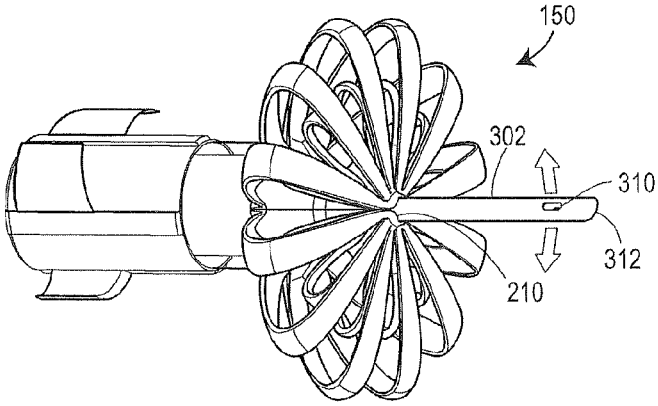
FIG. 15 illustrates the projectile assembly upon impact with a target.

In some embodiments, a filling device 900 may be inserted into the cannula 302 (FIG. 3) of the projectile assembly 150 to fill the payload area of the syringe assembly 300, 350. In some embodiments, a filling device 900 of 20 mL or greater capacity may be inserted into an exit port 310 of the cannula 302 to fill a payload area. The filling device 900 may include a needleless syringe, a syringe fitted with a cannula that is a smaller diameter than the cannula 302, a tube and pump, etc. After filling the payload area, the user may release the cone assembly so that the fore-end ring 210 seals the exit port 310. In other embodiments, the syringe assembly may be filled from a rear filling port or by a device during assembly of the projectile. At FIG. 10, a pressurized fluid dispenser 1000 may be affixed to a valve stem 412 (FIG. 4) of the valve 410 to fill an enclosed or hollow area 307C behind the plunger seal 307A. As described above, the area 307C may be filled to a pressure of approximately 10 to 15 Newton-meters, or 7.3 to 11 foot-pounds to propel the plunger toward the cannula 302 and expel the payload in response to impact with a target. At FIG. 11, the projectile assembly 150 may be fitted into the wad 600. In some embodiments, a twisting motion between a leading edge of the wad and the closed end of the fins-cup assembly may cause the fins 402, 452 to flatten against the fins-cup body 401, 451 and the fins-cup may be inserted within the wad 600. As seen in FIGS. 12A and 12B, the projectile assembly 150 is seated within the wad 600 and the shell 700. As described above, the wad 600 and shell 700 may extend from any point along the fins-cup body 401, 451 to the cone ogive 206 (FIGS. 2A and 2B). FIG. 12A shows the wad 600 and the shell 700 extending to a base of the cone assembly when the projectile assembly is fully seated. FIG. 12A shows the wad 600 and shell 700 extending to a base of the cone assembly and covering the fins-cup assembly 400, 450 when the projectile assembly is fully seated. FIG. 12B shows the wad 600 and shell 700 extending to a base of the ogive 206 on the cone assembly and covering a substantial portion of the cone assembly 200 when the projectile assembly is fully seated. FIG. 13 illustrates the RTS 100 upon firing and exiting a firearm barrel. The wad sections 609 (FIG. 6) expand once the wad assembly 600 meets the increased air resistance upon exiting the barrel, causing the wad assembly 600 to fall away from the projectile assembly 150. As illustrated in FIG. 14, the fins 402, 452 extend outward from the fins-cup body 401, 451 once the wad assembly 600 falls away from the projectile assembly. The fins 402, 452 stabilize the projectile assembly 150 while in flight to a target. FIG. 15 illustrates the projectile assembly 150 in response to impact with a target. As described above, the cone assembly 200 is compressed along the cannula 302, moving the fore-end ring 210A from the extended first position toward the hub/head 304 to the retracted second position and the cannula 302 enters the target. Each cone section 202 bends as described above in relation to FIG. 2H, separating the cone sections 202 from each other and releasing a payload from the cone payload area 215. Once the fore-end ring 210A slides below the exit ports 310, pressure within the syringe body 306 or pouch 360 causes the syringe payload to be expressed through the exit ports 310 and into the target. Once the syringe internal pressure is equal to atmospheric pressure at the target, the projectile assembly 150 may fall away from the target.

Figure 16:
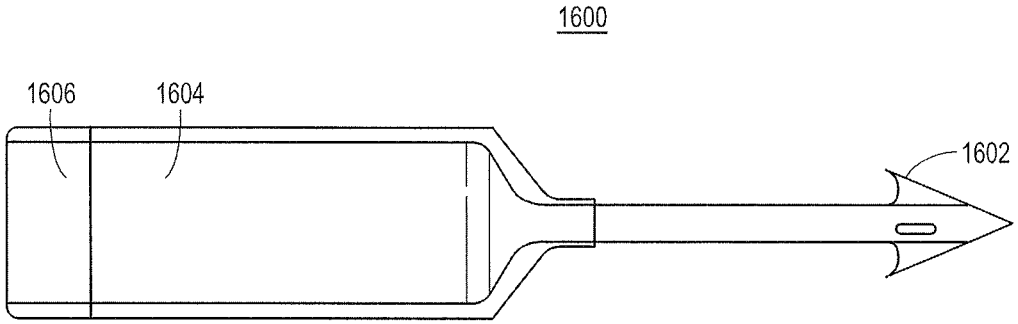
FIG. 16 illustrates an alternative embodiment of a projectile assembly including a barbed hook.

While the projectile assembly 150 described above is generally applicable for intra-muscular delivery of vaccinations, treatments, and inoculants by a twelve-gauge shot or slug-gun, the assembly 150 or portions of the assembly may be applicable in other applications. For example, rather than liquid treatments, inoculants, data and/or tracking system components, the projectile assembly 150 may deliver a payload assembly that includes a device for use with a satellite or radio tracking and information system (e.g., a global positioning system (GPS) locator, an IRIDIUM satellite constellation link microchip, a radio transmitter, a radio frequency identification chip, etc.). Likewise, with reference to FIG. 16, a syringe assembly 1600 cannula may include a barbed hook 1602. The payload 1604 may include a transmitting or data gathering device 1604 for use with a satellite or radio frequency tracking and information system. The projectile assembly 150 may implant the barbed hook 1602 in the skin of the target without imparting significant, injury-producing shock on the target area. The barbed-hook 1602 may also be self-discarding in that, over time, the hook may work its way out of the target's skin after tracking or data-gathering activities have been concluded. Further, the tracking device 1604 may include a floatation device 1606 that permits recovery of the tracking device in water should the target be found in a marine habitat.

Figure 17:
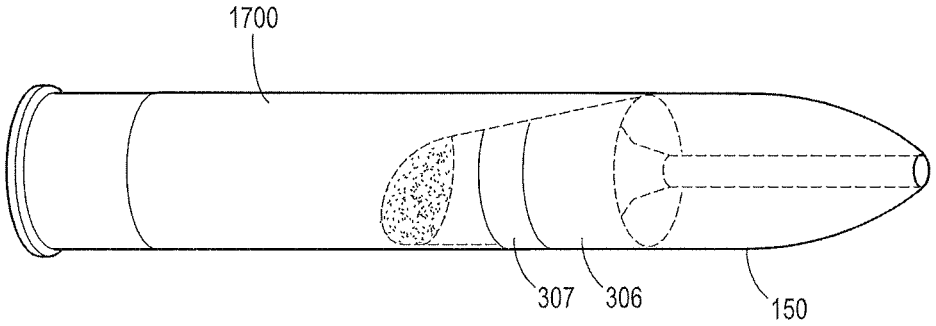
FIG. 17 illustrates a rifle-deployed embodiment of a remote treatment system.

With reference to FIG. 17, the projectile assembly 150 may be sized for delivery systems other than a standard shot or slug-gun. For example, a projectile assembly 150 may be sized for a large-caliber, sub-sonic rifle cartridge 1700 (e.g., a .45-70 Government cartridge, .50-90 Sharps, .300 Whisper, .500 Phantom, etc.) or other type of rifle cartridge. The smaller syringe assembly 300 of a projectile assembly 150 for such rifle cartridges may be reduced from the 4.5 mL capacity of the syringe assembly 300 described herein. A syringe body 306 for a .45-70 Government-sized projectile assembly 150 may be approximately 2 mL. In some embodiments, a projectile assembly 150 used in a rifle cartridge 1700 may be spin-stabilized rather than fin-stabilized, and may not include both the fins 402, 452 of the fins-cup assembly 400 and the wad assembly 500. In other embodiments, the syringe assembly is removed and the cone assembly is a frangible projectile that is capable of delivering medicine, vitamins, and other inoculants or treatments to a target.

The above-described embodiments are given for describing rather than limiting the scope of the invention, and modifications and variations may be resorted to without departing from the spirit and scope of the invention as those skilled in the art readily understand. Such modifications and variations are considered to be within the scope of the invention and the appended claims. The protection scope of the invention is defined by the accompanying claims. In addition, any of the reference numerals in the claims should not be interpreted as a limitation to the claims. Use of the verb "comprise" and its conjugations does not exclude the presence of elements or steps other than those stated in a claim. The indefinite article "a" or "an" preceding an element or step does not exclude the presence of a plurality of such elements or steps.

What is claimed:

1. A remote treatment system for remotely delivering a payload to a living target, the remote treatment system comprising:

a projectile assembly configured to be fired from a delivery system and projected toward the living target, the projectile assembly comprising:

a cone assembly including a fore-end ring at an apex of the cone assembly and a base ring at a center of a base of the cone assembly, the fore-end ring and base ring radially joining a plurality of deformable sections around a cylindrical core extending through the fore-end ring and the base ring, each section including a first portion, a second portion, and a pivot connecting the first portion to the second portion, and each section being shiftable about the pivot between an undeformed first position and a deformed second position; and, a syringe assembly including a cannula carried by the cylindrical core, the fore-end ring being shiftable along a longitudinal axis of the cannula between an extended first position and a retracted second position; and wherein the payload is carried by the projectile assembly, and wherein, in response to an impact between the cone assembly and the living target, each section of the cone assembly and the fore-end ring shifts to its respective second position, thereby causing the payload to be delivered to the living target.

2. The remote treatment system of claim 1, wherein the cannula includes a solid bevel tip, an exit port on a longitudinal side of the cannula, and a base, and the fore-end ring is in a sealing relation to the cannula.

3. The remote treatment system of claim 2, wherein both the fore-end ring and the base ring have an inner diameter sized to receive the cannula.

4. The remote treatment system of claim 3, wherein the fore-end ring is further in a sealing relation to the cannula exit port when the fore-end ring is in the extended first position and the fore-end ring is not in the sealing relation to the cannula exit port when the fore-end ring is in the retracted second position.

5. The remote treatment system of claim 4, wherein the payload is carried within the syringe assembly, and wherein, in response to the impact between the cone assembly and the living target, at least one of kinetic energy and pressure means causes the payload within the syringe assembly to be expressed from the cannula exit port and delivered to the living target.

6. The remote treatment system of claim 5, wherein the payload includes one or more of a fluid treatment and a tracking device.

7. The remote treatment system of claim 5, wherein the syringe assembly further includes a hollow cylindrical syringe body, the syringe body having a front end and an open end, the front end and open end opposing each other along a longitudinal axis of the syringe body, the cannula base being affixed to the front end.

8. The remote treatment system of claim 7, wherein the syringe assembly further includes a plunger assembly, the syringe body open end has an inner diameter sized to receive an outer diameter of the plunger assembly, and the outer diameter of the plunger assembly is sized for a sealing relation with the syringe body at the open end.

9. The remote treatment system of claim 8, further including a fins-cup assembly coupled to the syringe assembly and configured to stabilize the cone assembly and the syringe assembly during flight of the projectile assembly, the fins-cup assembly having a hollow cylindrical fins-cup body, the fins-cup body having an inner diameter sized to receive an outer diameter of the syringe body, and the fins-cup body having an open front end and a closed back end.

10. The remote treatment system of claim 9, comprising pressure means, wherein the pressure means biases the plunger assembly against the payload, and the payload is positioned within the syringe body between the syringe body front end and the syringe body open end.

11. The remote treatment system of claim 10, wherein the pressure means is positioned between the fins-cup assembly closed back end and the plunger assembly and the pressure means includes one or more of a compressed fluid and a compressed coil spring.

12. The remote treatment system of claim 11, wherein the fins-cup closed end includes a filling valve configured to receive the compressed fluid.

13. The remote treatment system of claim 12 comprising compressed fluid pressure means, wherein the fins-cup closed end includes a release valve configured to release a portion of the compressed fluid received therein.

14. The remote treatment system of claim 13, wherein the portion of the received compressed fluid that is released from the release valve reduces a pressure within a volume bounded by the fins-cup closed end, the fins-cup body, and the plunger assembly.

15. The remote treatment system of claim 9, wherein the fins-cup body further includes stabilizing means.

16. The remote treatment system of claim 15, wherein the stabilizing means includes a plurality of fins.

17. The remote treatment system of claim 1, wherein the cannula includes a hollow bevel tip and a base.

18. The remote treatment system of claim 17, wherein both the fore-end ring and the base ring have an inner diameter sized to receive the cannula.

19. The remote treatment system of claim 18, wherein the payload is carried by the syringe assembly, and wherein, in response to an impact between the cone assembly and the living target, at least one of kinetic energy and pressure means causes the payload within the syringe assembly to be expressed from the cannula hollow bevel tip and delivered to the living target.

20. The remote treatment system of claim 19, wherein the syringe assembly further includes an expandable pouch having a pouch body sized to receive the payload and a pouch neck including an inner diameter sized to fit in sealing relation around the cannula base, and the hollow cylindrical syringe body has an inner diameter sized to receive the expandable pouch.

21. The remote treatment system of claim 20, wherein the syringe assembly further includes a slider assembly having a slider body and a hollow slider frame, the slider frame having inside diameters sized to receive the cannula base at one end of the slider frame and to receive the slider body at an opposite end of the slider frame, the slider frame including a slider frame filling hole and a slider frame purging hole, the slider body including a slider body purging hole.

22. The remote treatment system of claim 21, wherein the pouch neck is further sized to fit in sealing relation around the slider frame and against the slider frame filling hole, and the slider body is shiftable within the slider frame between a filling position and a purging position.

23. The remote treatment system of claim 22, wherein, in the filling position, the slider body filling hole is open and the slider body purging hole and the slider frame purging hole are blocked, and, in the purging position, the slider body purging hole and the slider frame purging hole are open.

24. The remote treatment system of claim 23, wherein, in response to the impact between the cone assembly and the target, the slider body shifts from the filling position to the purging position.

25. The remote treatment system of claim 24, wherein the slider body includes a weight cap including a diameter sized larger than the slider frame diameter.

26. A remote treatment system for remotely delivering a payload to a living target, the remote treatment system comprising:

a projectile assembly configured to be fired from a delivery system and projected toward the living target, the projectile assembly comprising:

a syringe assembly including a cannula, the cannula including a solid bevel tip and an exit port on a longitudinal side of the cannula; and a cone assembly including a fore-end ring at an apex of the cone assembly and a base ring at a center of a base of the cone assembly, the fore-end ring and base ring carrying the cannula, the fore-end ring being shiftable along a longitudinal axis of the cannula between an extended first position and a retracted second position, the fore-end ring being in a sealing relation with the cannula exit port in the extended first position, the exit port being unsealed with the fore-end ring in the retracted second position, and the fore-end ring and base ring being joined by one or more deformable sections;

wherein the payload is carried by the projectile assembly, and wherein, in response to an impact between the cone assembly and the living target, the fore-end ring shifts to its second position, thereby causing the payload to be delivered to the living target.

27. The remote treatment system of claim 26, wherein each deformable section includes an inner rib, an outer rib, and a pivot connecting the inner rib to the outer rib, and each section is shiftable about the pivot between an un-deformed first position and a deformed second position, and further in response to the impact between the cone assembly and the living target, each deformable section shifts to its second position.

28. The remote treatment system of claim 26, wherein the deformable section includes a deformable foam projectile including a first portion, a second portion, and a pivot connecting the first portion to the second portion, and each portion is shiftable about the pivot between an un-deformed first position and a deformed second position, and further in response to the impact between the cone assembly and the living target, each deformable section shifts to its second position.

29. The remote treatment system of claim 26, wherein the payload is carried within the syringe assembly, and wherein, in response to the impact between the cone assembly and the target, at least one of kinetic energy and pressure means causes the payload within the syringe assembly to be expressed from the cannula exit port and delivered to the living target.

30. The remote treatment system of claim 29, wherein the payload includes one or more of a fluid treatment and a tracking device.

31. The remote treatment system of claim 29, wherein the syringe assembly further includes:

a hollow cylindrical syringe body, the syringe body having a front end and an open end, the front end and the open end opposing each other along a longitudinal axis of the syringe body, the cannula base being affixed to the front end, and a plunger assembly, the syringe body open end having an inner diameter sized to receive an outer diameter of the plunger assembly, and the outer diameter of the plunger assembly being sized for a sealing relation with the syringe body at the open end.

32. The remote treatment system of claim 31, further including a fins-cup assembly coupled to the syringe assembly and configured to stabilize the cone assembly and the syringe assembly during flight of the projectile assembly, the fins-cup assembly having a hollow cylindrical fins-cup body, the fins-cup body having:

an inner diameter sized to receive an outer diameter of the syringe body, an open front end and a closed back end, and stabilizing means including a plurality of fins.

33. The remote treatment system of claim 32, comprising pressure means, wherein the pressure means biases the plunger assembly against the payload, the payload is positioned within the syringe body between the syringe body front end and the syringe body open end, the pressure means is positioned between the fins-cup assembly closed back end and the plunger assembly, and the pressure means includes one or more of a compressed fluid and a compressed coil spring.

34. The remote treatment system of claim 33, wherein the fins-cup closed end includes a filling valve configured to receive the compressed fluid.

35. The remote treatment system of claim 34, wherein the fins-cup closed end includes a release valve configured to release a portion of the received compressed fluid.

36. The remote treatment system of claim 29, wherein the syringe assembly further includes:

an expandable pouch having a pouch body sized to receive the payload and a pouch neck including an inner diameter sized to fit in sealing relation around the cannula base, and the hollow cylindrical syringe body includes an inner diameter sized to receive the expandable pouch, and, a slider assembly having a slider body and a hollow slider frame, the slider frame having inside diameters sized to receive the cannula base at one end of the slider frame and to receive the slider body at an opposite end of the slider frame, the slider frame including a slider frame filling hole and a slider frame purging hole, the slider body including a slider body purging hole, wherein the pouch neck is further sized to fit in sealing relation around the slider frame and against the slider frame filling hole and the slider body is shiftable within the slider frame between a filling position and a purging position.

37. The remote treatment system of claim 36, wherein, in the filling position, the slider body filling hole is open and the slider body purging hole and the slider frame purging hole are blocked, and, in the purging position, the slider body purging hole and the slider frame purging hole are open.

38. The remote treatment system of claim 37, wherein, in response to the impact between the cone assembly and the living target, the slider body shifts from the filling position to the purging position.

39. The remote treatment system of claim 38, wherein the slider body includes a weight cap including a diameter sized larger than the slider frame diameter.

40. A remote treatment system for remotely delivering a payload to a living target, the remote treatment system comprising:

a projectile assembly configured to be fired from a delivery system and projected toward the living target, the projectile assembly comprising:

a syringe assembly including a cannula, the cannula including a solid bevel tip and an exit port on a longitudinal side of the cannula; and a cone assembly including a fore-end ring at an apex of the cone assembly and a base ring at a center of a base of the cone assembly, the fore-end ring and base ring carrying the cannula, the fore-end ring being shiftable along a longitudinal axis of the cannula between an extended first position and a retracted second position, the fore-end ring being in a sealing relation with the cannula exit port in the extended first position, the exit port being unsealed with the fore-end ring in the retracted second position, and the fore-end ring and base ring being formed by one or more deformable sections, each deformable section including an inner rib, an outer rib, and a pivot connecting the inner rib to the outer rib, and each section is shiftable about the pivot between an un-deformed first position and a deformed second position;

wherein the payload is carried by the projectile assembly, and wherein, in response to an impact between the cone assembly and the living target, each deformable section of the cone assembly and the fore-end ring shift to their respective second positions, thereby causing the payload to be delivered to the living target.

41. The remote treatment system of claim 40, wherein the payload is carried within the syringe assembly, and wherein, in response to the impact between the cone assembly and the living target, one or more of kinetic energy and pressure means causes the payload within the syringe assembly to be expressed from the cannula exit port and delivered to the living target.

42. The remote treatment system of claim 41, wherein the payload includes one or more of a fluid treatment and a tracking device.

43. The remote treatment system of claim 41, wherein the syringe assembly further includes:

a hollow cylindrical syringe body, the syringe body having a front end and an open end, the front end and open end opposing each other along a longitudinal axis of the syringe body, the cannula base being affixed to the front end, and a plunger assembly, the syringe body open end having an inner diameter sized to receive an outer diameter of the plunger assembly, and the outer diameter of the plunger assembly is sized for a sealing relation with the syringe body at the open end.

44. The remote treatment system of claim 43, further including a fins-cup assembly coupled to the syringe assembly and configured to stabilize the cone assembly and the syringe assembly during flight of the projectile assembly, the fins-cup assembly having a hollow cylindrical fins-cup body, the fins-cup body having:

an inner diameter sized to receive an outer diameter of the syringe body, an open front end and a closed back end, and a stabilizing means including a plurality of fins.

45. The remote treatment system of claim 44 comprising pressure means, wherein the pressure means biases the plunger assembly against the payload, the payload is positioned within the syringe body between the syringe body front end and the syringe body open end, the pressure means is positioned between the fins-cup assembly closed back end and the plunger assembly, and the pressure means includes one or more of a compressed fluid and a compressed coil spring.

46. The remote treatment system of claim 45, wherein the fins-cup closed end includes a filling valve configured to receive the compressed fluid.

47. The remote treatment system of claim 46, wherein the fins-cup closed end includes a release valve configured to release a portion of the received compressed fluid.

48. The remote treatment system of claim 45, wherein the pressure means includes a chemical reaction caused by one or more breakable capsules containing reactants.

49. The remote treatment system of claim 48, wherein the syringe body is constructed of a metal and the reactant includes one or more of hydrochloric or sulfuric acid.

50. The remote treatment system of claim 49, wherein the metal includes zinc.

51. The remote treatment system of claim 41, wherein the syringe assembly further includes:

an expandable pouch having a pouch body sized to receive the payload and a pouch neck including an inner diameter sized to fit in sealing relation around the cannula base, and the hollow cylindrical syringe body includes an inner diameter sized to receive the expandable pouch, and a slider assembly having a slider body and a hollow slider frame, the slider frame having inside diameters sized to receive the cannula base at one end of the slider frame and to receive the slider body at an opposite end of the slider frame, the slider frame including a slider frame filling hole and a slider frame purging hole, the slider body including a slider body purging hole, wherein the pouch neck is further sized to fit in sealing relation around the slider frame and against the slider frame filling hole and the slider body is shiftable within the slider frame between a filling position and a purging position.

52. The remote treatment system of claim 51, wherein, in the filling position, the slider body filling hole is open and the slider body purging hole and the slider frame purging hole are blocked, and, in the purging position, the slider body purging hole and the slider frame purging hole are open.

53. The remote treatment system of claim 52, wherein, in response to the impact between the cone assembly and the target, the slider body shifts from the filling position to the purging position.

54. The remote treatment system of claim 40, wherein the cone assembly is deformable to fill the syringe assembly.

55. The remote treatment system of claim 40, wherein the syringe assembly includes a plurality of cannulae.

* * * * *